US009474957B2

(12) United States Patent
Haushalter et al.

(10) Patent No.: US 9,474,957 B2
(45) Date of Patent: Oct. 25, 2016

(54) PLAYING CARD HANDLING DEVICES, SYSTEMS, AND METHODS FOR VERIFYING SETS OF CARDS

(71) Applicant: BALLY GAMING, INC., Las Vegas, NV (US)

(72) Inventors: Todd M. Haushalter, Las Vegas, NV (US); Nathan J. Wadds, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 40 days.

(21) Appl. No.: 14/279,161

(22) Filed: May 15, 2014

(65) Prior Publication Data

US 2015/0328533 A1 Nov. 19, 2015

(51) Int. Cl.

| | |
|---|---|
| ***A63F 1/12*** | (2006.01) |
| ***A63F 1/14*** | (2006.01) |
| *A63F 3/06* | (2006.01) |

(52) U.S. Cl.

CPC . *A63F 1/12* (2013.01); *A63F 1/14* (2013.01); *A63F 2003/066* (2013.01); *A63F 2250/58* (2013.01)

(58) Field of Classification Search

CPC . A63F 1/12; A63F 2003/066; A63F 2250/58
USPC ..... 273/149 R, 149 P; 463/22, 29
See application file for complete search history.

(56) References Cited

U.S. PATENT DOCUMENTS

| | | | |
|---|---|---|---|
| 130,281 | A | 8/1872 | Coughlik |
| 205,030 | A | 6/1878 | Ash |
| 609,730 | A | 8/1898 | Booth |
| 673,154 | A | 4/1901 | Bellows |
| 793,489 | A | 6/1905 | Williams |

(Continued)

FOREIGN PATENT DOCUMENTS

| | | | |
|---|---|---|---|
| AU | 5025479 | A | 3/1980 |
| AU | 757636 | B2 | 2/2003 |

(Continued)

OTHER PUBLICATIONS

VendingData Corporation's Opposition to Shuffle Master Inc.'s Motion for Preliminary Injection for *Shuffle Master, Inc.* vs. *VendingData Corporation*, In the U.S. District Court, District of Nevada, No. CV-S-04-1373-JCM-LRL, Nov. 12, 2004.

(Continued)

*Primary Examiner* — Benjamin Layno
(74) *Attorney, Agent, or Firm* — TraskBritt

(57) ABSTRACT

Systems include an automatic card shuffler and a shoe. The automatic card shuffler may include a printing device for applying a randomly selected set symbol on each cards of a set of cards. The shoe may include a set symbol reader for reading each card for a presence and identity of a set symbol. A shoe processor may be configured to receive a signal from a shuffler processor indicating the selected set symbol to enable the shoe processor to verify that each card belongs to the set of cards. An automatic card shuffler includes a processor programmed to randomly select a card set symbol and a card-marking system for forming the randomly selected set symbol on cards. Methods include forming a randomly determined set symbol on each card of a set of cards and detecting whether cards include a set symbol matching the determined set symbol.

21 Claims, 6 Drawing Sheets

(56) References Cited

U.S. PATENT DOCUMENTS

| | | | |
|---|---|---|---|
| 892,389 | A | 7/1908 | Bellows |
| 1,014,219 | A | 1/1912 | Hall |
| 1,043,109 | A | 11/1912 | Hurm |
| 1,157,898 | A | 10/1915 | Perret |
| 1,556,856 | A | 10/1925 | Lipps |
| 1,757,553 | A | 5/1930 | Gustav |
| 1,850,114 | A | 3/1932 | McCaddin |
| 1,885,276 | A | 11/1932 | McKay |
| 1,955,926 | A | 4/1934 | Matthaey |
| 1,992,085 | A | 2/1935 | McKay |
| 1,998,690 | A | 4/1935 | Shepherd et al. |
| 2,001,220 | A | 5/1935 | Smith |
| 2,001,918 | A | 5/1935 | Nevius |
| 2,016,030 | A | 10/1935 | Rose |
| 2,043,343 | A | 6/1936 | Warner |
| 2,060,096 | A | 11/1936 | McCoy |
| 2,065,824 | A | 12/1936 | Plass |
| 2,159,958 | A | 5/1939 | Sachs |
| 2,185,474 | A | 1/1940 | Nott |
| 2,254,484 | A | 9/1941 | Hutchins |
| D132,360 | S | 5/1942 | Gardner |
| 2,328,153 | A | 8/1943 | Laing |
| 2,328,879 | A | 9/1943 | Isaacson |
| 2,364,413 | A | 12/1944 | Wittel |
| 2,525,305 | A | 10/1950 | Lombard |
| 2,543,522 | A | 2/1951 | Cohen |
| 2,588,582 | A | 3/1952 | Sivertson |
| 2,661,215 | A | 12/1953 | Stevens |
| 2,676,020 | A | 4/1954 | Ogden |
| 2,692,777 | A | 10/1954 | Miller |
| 2,701,720 | A | 2/1955 | Ogden |
| 2,705,638 | A | 4/1955 | Newcomb |
| 2,711,319 | A | 6/1955 | Morgan et al. |
| 2,714,510 | A | 8/1955 | Oppenlander et al. |
| 2,717,782 | A | 9/1955 | Droll |
| 2,727,747 | A | 12/1955 | Semisch, Jr. |
| 2,731,271 | A | 1/1956 | Brown |
| 2,747,877 | A | 5/1956 | Howard |
| 2,755,090 | A | 7/1956 | Aldrich |
| 2,757,005 | A | 7/1956 | Nothaft |
| 2,760,779 | A | 8/1956 | Ogden et al. |
| 2,770,459 | A | 11/1956 | Wilson et al. |
| 2,778,643 | A | 1/1957 | Williams |
| 2,778,644 | A | 1/1957 | Stephenson |
| 2,782,040 | A | 2/1957 | Matter |
| 2,790,641 | A | 4/1957 | Adams |
| 2,793,863 | A | 5/1957 | Liebelt |
| 2,815,214 | A | 12/1957 | Hall |
| 2,821,399 | A | 1/1958 | Heinoo |
| 2,914,215 | A | 11/1959 | Neidig |
| 2,937,739 | A | 5/1960 | Levy |
| 2,950,005 | A | 8/1960 | MacDonald |
| RE24,986 | E | 5/1961 | Stephenson |
| 3,067,885 | A | 12/1962 | Kohler |
| 3,107,096 | A | 10/1963 | Osborn |
| 3,124,674 | A | 3/1964 | Edwards et al. |
| 3,131,935 | A | 5/1964 | Grönneberg |
| 3,147,978 | A | 9/1964 | Sjöstrand |
| 3,222,071 | A | 12/1965 | Lang |
| 3,235,741 | A | 2/1966 | Plaisance |
| 3,288,308 | A | 11/1966 | Gingher |
| 3,305,237 | A | 2/1967 | Granius |
| 3,312,473 | A | 4/1967 | Friedman et al. |
| 3,452,509 | A | 7/1969 | Werner |
| 3,530,968 | A | 9/1970 | Palmer |
| 3,588,116 | A | 6/1971 | Miura |
| 3,589,730 | A | 6/1971 | Slay |
| 3,595,388 | A | 7/1971 | Castaldi |
| 3,597,076 | A | 8/1971 | Hubbard |
| 3,618,933 | A | 11/1971 | Roggenstein |
| 3,627,331 | A | 12/1971 | Erickson |
| 3,666,270 | A | 5/1972 | Mazur |
| 3,680,853 | A | 8/1972 | Houghton |
| 3,690,670 | A | 9/1972 | Cassady et al. |
| 3,704,938 | A | 12/1972 | Fanselow |
| 3,716,238 | A | 2/1973 | Porter |
| 3,751,041 | A | 8/1973 | Seifert |
| 3,761,079 | A | 9/1973 | Azure |
| 3,810,627 | A | 5/1974 | Levy |
| 3,861,261 | A | 1/1975 | Maxey |
| 3,897,954 | A | 8/1975 | Erickson et al. |
| 3,909,002 | A | 9/1975 | Levy |
| 3,929,339 | A | 12/1975 | Mattioli et al. |
| 3,944,077 | A | 3/1976 | Green |
| 3,944,230 | A | 3/1976 | Fineman |
| 3,949,219 | A | 4/1976 | Crouse |
| 3,968,364 | A | 7/1976 | Miller |
| 4,023,705 | A | 5/1977 | Reiner et al. |
| 4,033,590 | A | 7/1977 | Pic |
| 4,072,930 | A | 2/1978 | Lucero et al. |
| 4,088,265 | A | 5/1978 | Garczynski et al. |
| 4,151,410 | A | 4/1979 | McMillan et al. |
| 4,159,581 | A | 7/1979 | Lichtenberg |
| 4,162,649 | A | 7/1979 | Thornton |
| 4,166,615 | A | 9/1979 | Noguchi et al. |
| 4,232,861 | A | 11/1980 | Maul |
| 4,280,690 | A | 7/1981 | Hill |
| 4,283,709 | A | 8/1981 | Lucero et al. |
| 4,310,160 | A | 1/1982 | Willette |
| 4,339,134 | A | 7/1982 | Macheel |
| 4,339,798 | A | 7/1982 | Hedges et al. |
| 4,361,393 | A | 11/1982 | Noto |
| 4,368,972 | A | 1/1983 | Naramore |
| 4,369,972 | A | 1/1983 | Parker |
| 4,374,309 | A | 2/1983 | Walton |
| 4,377,285 | A | 3/1983 | Kadlic |
| 4,385,827 | A | 5/1983 | Naramore |
| 4,388,994 | A | 6/1983 | Suda et al. |
| 4,397,469 | A | 8/1983 | Carter |
| 4,421,312 | A | 12/1983 | Delgado et al. |
| 4,421,501 | A | 12/1983 | Scheffer |
| D274,069 | S | 5/1984 | Fromm |
| 4,467,424 | A | 8/1984 | Hedges et al. |
| 4,494,197 | A | 1/1985 | Troy et al. |
| 4,497,488 | A | 2/1985 | Plevyak et al. |
| 4,512,580 | A | 4/1985 | Matviak |
| 4,513,969 | A | 4/1985 | Samsel |
| 4,515,367 | A | 5/1985 | Howard |
| 4,531,187 | A | 7/1985 | Uhland et al. |
| 4,534,562 | A | 8/1985 | Cuff et al. |
| 4,549,738 | A | 10/1985 | Greitzer |
| 4,566,782 | A | 1/1986 | Britt et al. |
| 4,575,367 | A | 3/1986 | Karmel |
| 4,586,712 | A | 5/1986 | Lorber et al. |
| 4,659,082 | A | 4/1987 | Greenberg |
| 4,662,637 | A | 5/1987 | Pfeiffer et al. |
| 4,662,816 | A | 5/1987 | Fabrig |
| 4,667,959 | A | 5/1987 | Pfeiffer et al. |
| 4,741,524 | A | 5/1988 | Bromage |
| 4,750,743 | A | 6/1988 | Nicoletti |
| 4,755,941 | A | 7/1988 | Bacchi |
| 4,759,448 | A | 7/1988 | Kawabata |
| 4,770,412 | A | 9/1988 | Wolfe |
| 4,770,421 | A | 9/1988 | Hoffman |
| 4,807,884 | A | 2/1989 | Breeding |
| 4,822,050 | A | 4/1989 | Normand et al. |
| 4,832,342 | A | 5/1989 | Plevyak |
| 4,858,000 | A | 8/1989 | Lu |
| 4,861,041 | A | 8/1989 | Jones et al. |
| 4,876,000 | A | 10/1989 | Mikhail |
| 4,900,009 | A | 2/1990 | Kitahara et al. |
| 4,904,830 | A | 2/1990 | Rizzuto |
| 4,921,109 | A | 5/1990 | Hasuo et al. |
| 4,926,327 | A | 5/1990 | Sidley |
| 4,948,134 | A | 8/1990 | Suttle et al. |
| 4,951,950 | A | 8/1990 | Normand et al. |
| 4,969,648 | A | 11/1990 | Hollinger et al. |
| 4,993,587 | A | 2/1991 | Abe |
| 4,995,615 | A | 2/1991 | Cheng et al. |
| 5,000,453 | A | 3/1991 | Stevens et al. |
| 5,039,102 | A | 8/1991 | Miller |
| 5,067,713 | A | 11/1991 | Soules et al. |
| 5,078,405 | A | 1/1992 | Jones et al. |
| 5,081,487 | A | 1/1992 | Hoyer et al. |

(56) References Cited

U.S. PATENT DOCUMENTS

| | | | |
|---|---|---|---|
| 5,096,197 | A | 3/1992 | Embury |
| 5,102,293 | A | 4/1992 | Schneider |
| 5,118,114 | A | 6/1992 | Tucci |
| 5,121,192 | A | 6/1992 | Kazui |
| 5,121,921 | A | 6/1992 | Friedman |
| 5,146,346 | A | 9/1992 | Knoll |
| 5,154,429 | A | 10/1992 | LeVasseur et al. |
| 5,179,517 | A | 1/1993 | Sarbin et al. |
| 5,197,094 | A | 3/1993 | Tillery et al. |
| 5,199,710 | A | 4/1993 | Lamle |
| 5,209,476 | A | 5/1993 | Eiba et al. |
| 5,224,712 | A | 7/1993 | Laughlin et al. |
| 5,240,140 | A | 8/1993 | Huen |
| 5,248,142 | A | 9/1993 | Breeding et al. |
| 5,257,179 | A | 10/1993 | DeMar et al. |
| 5,259,907 | A | 11/1993 | Soules et al. |
| 5,261,667 | A | 11/1993 | Breeding |
| 5,267,248 | A | 11/1993 | Reyner |
| 5,275,411 | A | 1/1994 | Breeding |
| 5,276,312 | A | 1/1994 | McCarthy |
| 5,283,422 | A | 2/1994 | Storch et al. |
| 5,288,081 | A | 2/1994 | Breeding et al. |
| 5,299,089 | A | 3/1994 | Lwee et al. |
| 5,303,921 | A | 4/1994 | Breeding |
| 5,344,146 | A | 9/1994 | Lee |
| 5,356,145 | A | 10/1994 | Verschoor |
| 5,362,053 | A | 11/1994 | Miller et al. |
| 5,374,061 | A | 12/1994 | Albrecht et al. |
| 5,377,973 | A | 1/1995 | Jones et al. |
| 5,382,024 | A | 1/1995 | Blaha |
| 5,382,025 | A | 1/1995 | Sklansky et al. |
| 5,390,910 | A | 2/1995 | Mandel et al. |
| 5,397,128 | A | 3/1995 | Hesse et al. |
| 5,397,133 | A | 3/1995 | Penzias et al. |
| 5,416,308 | A | 5/1995 | Hood et al. |
| 5,431,399 | A | 7/1995 | Kelley et al. |
| 5,431,407 | A | 7/1995 | Hofberg et al. |
| 5,437,462 | A | 8/1995 | Breeding et al. |
| 5,445,377 | A | 8/1995 | Steinbach |
| 5,470,079 | A | 11/1995 | LeStrange et al. |
| D365,853 | S | 1/1996 | Zadro |
| 5,489,101 | A | 2/1996 | Moody et al. |
| 5,515,477 | A | 5/1996 | Sutherland |
| 5,524,888 | A | 6/1996 | Heidel |
| 5,531,448 | A | 7/1996 | Moody et al. |
| 5,544,892 | A | 8/1996 | Breeding et al. |
| 5,575,475 | A | 11/1996 | Steinbach |
| 5,584,483 | A | 12/1996 | Sines et al. |
| 5,586,766 | A | 12/1996 | Forte et al. |
| 5,586,936 | A | 12/1996 | Bennett et al. |
| 5,605,334 | A | 2/1997 | McCrea et al. |
| 5,613,912 | A | 3/1997 | Slater et al. |
| 5,632,483 | A | 5/1997 | Garczynski et al. |
| 5,636,843 | A | 6/1997 | Roberts et al. |
| 5,651,548 | A | 7/1997 | French et al. |
| 5,655,961 | A | 8/1997 | Acres et al. |
| 5,669,816 | A | 9/1997 | Garczynski et al. |
| 5,676,231 | A | 10/1997 | Legras et al. |
| 5,676,372 | A | 10/1997 | Sines et al. |
| 5,681,039 | A | 10/1997 | Miller et al. |
| 5,683,085 | A | 11/1997 | Johnson et al. |
| 5,685,543 | A | 11/1997 | Garner et al. |
| 5,690,324 | A | 11/1997 | Otomo et al. |
| 5,692,748 | A | 12/1997 | Frisco et al. |
| 5,695,189 | A | 12/1997 | Breeding et al. |
| 5,701,565 | A | 12/1997 | Morgan |
| 5,707,286 | A | 1/1998 | Carlson |
| 5,707,287 | A | 1/1998 | McCrea et al. |
| 5,711,525 | A | 1/1998 | Breeding et al. |
| 5,718,427 | A | 2/1998 | Cranford et al. |
| 5,719,288 | A | 2/1998 | Sens et al. |
| 5,720,484 | A | 2/1998 | Hsu et al. |
| 5,722,893 | A | 3/1998 | Hill et al. |
| 5,735,525 | A | 4/1998 | McCrea et al. |
| 5,735,724 | A | 4/1998 | Udagawa |
| 5,735,742 | A | 4/1998 | French et al. |
| 5,743,798 | A | 4/1998 | Adams et al. |
| 5,768,382 | A | 6/1998 | Schneier et al. |
| 5,770,533 | A | 6/1998 | Franchi et al. |
| 5,770,553 | A | 6/1998 | Kroner et al. |
| 5,772,505 | A | 6/1998 | Garczynski et al. |
| 5,779,546 | A | 7/1998 | Meissner et al. |
| 5,781,647 | A | 7/1998 | Fishbine et al. |
| 5,785,321 | A | 7/1998 | van Putten et al. |
| 5,788,574 | A | 8/1998 | Ornstein et al. |
| 5,791,988 | A | 8/1998 | Nomi et al. |
| 5,802,560 | A | 9/1998 | Joseph et al. |
| 5,803,808 | A | 9/1998 | Strisower |
| 5,810,355 | A | 9/1998 | Trilli |
| 5,813,326 | A | 9/1998 | Salomon et al. |
| 5,813,912 | A | 9/1998 | Shultz et al. |
| 5,814,796 | A | 9/1998 | Benson et al. |
| 5,836,775 | A | 11/1998 | Hiyama et al. |
| 5,839,730 | A | 11/1998 | Pike |
| 5,845,906 | A | 12/1998 | Wirth et al. |
| 5,851,011 | A | 12/1998 | Lott et al. |
| 5,867,586 | A | 2/1999 | Liang |
| 5,879,233 | A | 3/1999 | Stupero |
| 5,883,804 | A | 3/1999 | Christensen |
| 5,890,717 | A | 4/1999 | Rosewarne et al. |
| 5,892,210 | A | 4/1999 | Levasseur |
| 5,911,626 | A | 6/1999 | McCrea et al. |
| 5,919,090 | A | 7/1999 | Mothwurf |
| 5,936,222 | A | 8/1999 | Korsunsky et al. |
| 5,941,769 | A | 8/1999 | Order |
| 5,944,310 | A | 8/1999 | Johnson et al. |
| D414,527 | S | 9/1999 | Tedham |
| 5,957,776 | A | 9/1999 | Hoehne et al. |
| 5,974,150 | A | 10/1999 | Kaish et al. |
| 5,985,305 | A | 11/1999 | Peery et al. |
| 5,989,122 | A | 11/1999 | Roblejo et al. |
| 5,991,308 | A | 11/1999 | Fuhrmann et al. |
| 6,015,311 | A | 1/2000 | Benjamin et al. |
| 6,019,368 | A | 2/2000 | Sines et al. |
| 6,019,374 | A | 2/2000 | Breeding et al. |
| 6,039,650 | A | 3/2000 | Hill et al. |
| 6,050,569 | A | 4/2000 | Taylor |
| 6,053,695 | A | 4/2000 | Longoria et al. |
| 6,061,449 | A | 5/2000 | Candelore et al. |
| 6,068,258 | A | 5/2000 | Breeding et al. |
| 6,069,564 | A | 5/2000 | Hatano et al. |
| 6,071,190 | A | 6/2000 | Weiss et al. |
| 6,093,103 | A | 7/2000 | McCrea et al. |
| 6,113,101 | A | 9/2000 | Wirth et al. |
| 6,117,012 | A | 9/2000 | McCrea et al. |
| D432,588 | S | 10/2000 | Tedham |
| 6,126,166 | A | 10/2000 | Lorson et al. |
| 6,127,447 | A | 10/2000 | Mitry et al. |
| 6,131,817 | A | 10/2000 | Miller |
| 6,139,014 | A | 10/2000 | Breeding et al. |
| 6,149,154 | A | 11/2000 | Grauzer et al. |
| 6,154,131 | A | 11/2000 | Jones et al. |
| 6,165,069 | A | 12/2000 | Sines et al. |
| 6,165,072 | A | 12/2000 | Davis et al. |
| 6,183,362 | B1 | 2/2001 | Boushy |
| 6,186,895 | B1 | 2/2001 | Oliver |
| 6,200,218 | B1 | 3/2001 | Lindsay |
| 6,210,274 | B1 | 4/2001 | Carlson |
| 6,213,310 | B1 | 4/2001 | Wennersten et al. |
| 6,217,447 | B1 | 4/2001 | Lofink et al. |
| 6,234,900 | B1 | 5/2001 | Cumbers |
| 6,236,223 | B1 | 5/2001 | Brady et al. |
| 6,250,632 | B1 | 6/2001 | Albrecht |
| 6,254,002 | B1 | 7/2001 | Litman |
| 6,254,096 | B1 | 7/2001 | Grauzer et al. |
| 6,254,484 | B1 | 7/2001 | McCrea, Jr. |
| 6,257,981 | B1 | 7/2001 | Acres et al. |
| 6,267,248 | B1 | 7/2001 | Johnson et al. |
| 6,267,648 | B1 | 7/2001 | Katayama et al. |
| 6,267,671 | B1 | 7/2001 | Hogan |
| 6,270,404 | B2 | 8/2001 | Sines et al. |
| 6,272,223 | B1 | 8/2001 | Carlson |
| 6,293,546 | B1 | 9/2001 | Hessing et al. |
| 6,293,864 | B1 | 9/2001 | Romero |

(56) References Cited

U.S. PATENT DOCUMENTS 6,299,167 B1 10/2001 Sines et al.
6,299,534 B1 10/2001 Breeding et al.
6,299,536 B1 10/2001 Hill
6,308,886 B1 10/2001 Benson et al.
6,313,871 B1 11/2001 Schubert
6,325,373 B1 12/2001 Breeding et al.
6,334,614 B1 1/2002 Breeding
6,341,778 B1 1/2002 Lee
6,342,830 B1 1/2002 Want et al.
6,346,044 B1 2/2002 McCrea, Jr.
6,361,044 B1 3/2002 Block et al.
6,386,973 B1 5/2002 Yoseloff
6,402,142 B1 6/2002 Warren et al.
6,403,908 B2 6/2002 Stardust et al.
6,443,839 B2 9/2002 Stockdale
6,446,864 B1 9/2002 Kim et al.
6,454,266 B1 9/2002 Breeding et al.
6,460,848 B1 10/2002 Soltys et al.
6,464,584 B2 10/2002 Oliver
6,490,277 B1 12/2002 Tzotzkov
6,508,709 B1 1/2003 Karmarkar
6,514,140 B1 2/2003 Storch
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,561,897 B1 5/2003 Bourbour et al.
6,568,678 B2 5/2003 Breeding et al.
6,579,180 B2 6/2003 Soltys et al.
6,579,181 B2 6/2003 Soltys et al.
6,581,747 B1 6/2003 Charlier et al.
6,582,301 B2 6/2003 Hill
6,582,302 B2 6/2003 Romero
6,585,586 B1 7/2003 Romero
6,585,588 B2 7/2003 Hartl
6,585,856 B2 7/2003 Zwick et al.
6,588,750 B1 7/2003 Grauzer et al.
6,588,751 B1 7/2003 Grauzer et al.
6,595,857 B2 7/2003 Soltys et al.
6,609,710 B1 8/2003 Order
6,612,928 B1 9/2003 Bradford et al.
6,616,535 B1 9/2003 Nishizaki et al.
6,619,662 B2 9/2003 Miller
6,622,185 B1 9/2003 Johnson
6,626,757 B2 9/2003 Oliveras
6,629,019 B2 9/2003 Legge et al.
6,629,591 B1 10/2003 Griswold et al.
6,629,889 B2 10/2003 Mothwurf
6,629,894 B1 10/2003 Purton
6,637,622 B1 10/2003 Robinson
6,638,161 B2 10/2003 Soltys et al.
6,645,068 B1 11/2003 Kelly et al.
6,645,077 B2 11/2003 Rowe
6,651,981 B2 11/2003 Grauzer et al.
6,651,982 B2 11/2003 Grauzer et al.
6,651,985 B2 11/2003 Sines et al.
6,652,379 B2 11/2003 Soltys et al.
6,655,684 B2 12/2003 Grauzer et al.
6,655,690 B1 12/2003 Oskwarek
6,658,135 B1 12/2003 Morito et al.
6,659,460 B2 12/2003 Blaha et al.
6,659,461 B2 12/2003 Yoseloff et al.
6,659,875 B2 12/2003 Purton
6,663,490 B2 12/2003 Soltys et al.
6,666,768 B1 12/2003 Akers
6,671,358 B1 12/2003 Seidman et al.
6,676,127 B2 1/2004 Johnson et al.
6,676,517 B2 1/2004 Beavers
6,680,843 B2 1/2004 Farrow et al.
6,685,564 B2 2/2004 Oliver
6,685,567 B2 2/2004 Cockerille et al.
6,685,568 B2 2/2004 Soltys et al.
6,688,597 B2 2/2004 Jones
6,688,979 B2 2/2004 Soltys et al.
6,690,673 B1 2/2004 Jarvis
6,698,756 B1 3/2004 Baker et al.
6,698,759 B2 3/2004 Webb et al.
6,702,289 B1 3/2004 Feola
6,702,290 B2 3/2004 Buono-Correa et al.
6,709,333 B1 3/2004 Bradford et al.
6,712,696 B2 3/2004 Soltys et al.
6,719,288 B2 4/2004 Hessing et al.
6,719,634 B2 4/2004 Mishina et al.
6,722,974 B2 4/2004 Sines et al.
6,726,205 B1 4/2004 Purton
6,732,067 B1 5/2004 Powderly
6,733,012 B2 5/2004 Bui et al.
6,733,388 B2 5/2004 Mothwurf
6,746,333 B1 6/2004 Onda et al.
6,747,560 B2 6/2004 Stevens, III
6,749,510 B2 6/2004 Giobbi
6,758,751 B2 7/2004 Soltys et al.
6,758,757 B2 7/2004 Luciano, Jr. et al.
6,769,693 B2 8/2004 Huard et al.
6,774,782 B2 8/2004 Runyon et al.
6,789,801 B2 9/2004 Snow
6,802,510 B1 10/2004 Haber
6,804,763 B1 10/2004 Stockdale et al.
6,808,173 B2 10/2004 Snow
6,827,282 B2 12/2004 Silverbrook
6,834,251 B1 12/2004 Fletcher
6,840,517 B2 1/2005 Snow
6,842,263 B1 1/2005 Saeki
6,843,725 B2 1/2005 Nelson
6,848,616 B2 2/2005 Tsirline et al.
6,848,844 B2 2/2005 McCue, Jr. et al.
6,848,994 B1 2/2005 Knust et al.
6,857,961 B2 2/2005 Soltys et al.
6,874,784 B1 4/2005 Promutico
6,874,786 B2 4/2005 Bruno
6,877,657 B2 4/2005 Ranard et al.
6,877,748 B1 4/2005 Patroni
6,886,829 B2 5/2005 Hessing et al.
6,889,979 B2 5/2005 Blaha et al.
6,893,347 B1 5/2005 Zilliacus et al.
6,899,628 B2 5/2005 Leen et al.
6,902,167 B2 6/2005 Webb
6,905,121 B1 6/2005 Timpano
6,923,446 B2 8/2005 Snow
6,938,900 B2 9/2005 Snow
6,941,180 B1 9/2005 Fischer et al.
6,950,948 B2 9/2005 Neff
6,955,599 B2 10/2005 Bourbour et al.
6,957,746 B2 10/2005 Martin et al.
6,959,925 B1 11/2005 Baker et al.
6,959,935 B2 11/2005 Buhl et al.
6,960,134 B2 11/2005 Hartl et al.
6,964,612 B2 11/2005 Soltys et al.
6,986,514 B2 1/2006 Snow
6,988,516 B2 1/2006 Debaes et al.
7,011,309 B2 3/2006 Soltys et al.
7,020,307 B2 3/2006 Hinton et al.
7,028,598 B2 4/2006 Teshima
7,029,009 B2 4/2006 Grauzer et al.
7,036,818 B2 5/2006 Grauzer et al.
7,046,458 B2 5/2006 Nakayama
7,046,764 B1 5/2006 Kump
7,048,629 B2 5/2006 Sines et al.
7,059,602 B2 6/2006 Grauzer et al.
7,066,464 B2 6/2006 Blad et al.
7,068,822 B2 6/2006 Scott
7,073,791 B2 7/2006 Grauzer et al.
7,084,769 B2 8/2006 Bauer et al.
7,089,420 B1 8/2006 Durst et al.
7,106,201 B2 9/2006 Tuttle
7,113,094 B2 9/2006 Garber et al.
7,114,718 B2 10/2006 Grauzer et al.
7,124,947 B2 10/2006 Storch
7,128,652 B1 10/2006 Lavoie et al.

(56) References Cited

U.S. PATENT DOCUMENTS

| | | | |
|---|---|---|---|
| 7,137,627 | B2 | 11/2006 | Grauzer et al. |
| 7,139,108 | B2 | 11/2006 | Andersen et al. |
| 7,140,614 | B2 | 11/2006 | Snow |
| 7,162,035 | B1 | 1/2007 | Durst et al. |
| 7,165,769 | B2 | 1/2007 | Crenshaw et al. |
| 7,165,770 | B2 | 1/2007 | Snow |
| 7,175,522 | B2 | 2/2007 | Hartl |
| 7,186,181 | B2 | 3/2007 | Rowe |
| 7,201,656 | B2 | 4/2007 | Darder |
| 7,202,888 | B2 | 4/2007 | Tecu et al. |
| 7,203,841 | B2 | 4/2007 | Jackson et al. |
| 7,213,812 | B2 | 5/2007 | Schubert et al. |
| 7,222,852 | B2 | 5/2007 | Soltys et al. |
| 7,222,855 | B2 | 5/2007 | Sorge |
| 7,231,812 | B1 | 6/2007 | Lagare |
| 7,234,698 | B2 | 6/2007 | Grauzer et al. |
| 7,237,969 | B2 | 7/2007 | Bartman |
| 7,243,148 | B2 | 7/2007 | Keir et al. |
| 7,243,698 | B2 | 7/2007 | Siegel |
| 7,246,799 | B2 | 7/2007 | Snow |
| 7,255,344 | B2 | 8/2007 | Grauzer et al. |
| 7,255,351 | B2 | 8/2007 | Yoseloff et al. |
| 7,255,642 | B2 | 8/2007 | Sines et al. |
| 7,257,630 | B2 | 8/2007 | Cole et al. |
| 7,261,294 | B2 | 8/2007 | Grauzer et al. |
| 7,264,241 | B2 | 9/2007 | Schubert et al. |
| 7,264,243 | B2 | 9/2007 | Yoseloff et al. |
| 7,277,570 | B2 | 10/2007 | Armstrong |
| 7,278,923 | B2 | 10/2007 | Grauzer et al. |
| 7,294,056 | B2 | 11/2007 | Lowell et al. |
| 7,297,062 | B2 | 11/2007 | Gatto et al. |
| 7,300,056 | B2 | 11/2007 | Gioia et al. |
| 7,303,473 | B2 | 12/2007 | Rowe |
| 7,309,065 | B2 | 12/2007 | Yoseloff et al. |
| 7,316,609 | B2 | 1/2008 | Dunn et al. |
| 7,316,615 | B2 | 1/2008 | Soltys et al. |
| 7,322,576 | B2 | 1/2008 | Grauzer et al. |
| 7,331,579 | B2 | 2/2008 | Snow |
| 7,334,794 | B2 | 2/2008 | Snow |
| 7,338,362 | B1 | 3/2008 | Gallagher |
| 7,341,510 | B2 | 3/2008 | Bourbour et al. |
| 7,357,321 | B2 | 4/2008 | Yoshida et al. |
| 7,360,094 | B2 | 4/2008 | Neff |
| 7,367,561 | B2 | 5/2008 | Blaha et al. |
| 7,367,563 | B2 | 5/2008 | Yoseloff et al. |
| 7,367,884 | B2 | 5/2008 | Breeding et al. |
| 7,374,170 | B2 | 5/2008 | Grauzer et al. |
| 7,384,044 | B2 | 6/2008 | Grauzer et al. |
| 7,387,300 | B2 | 6/2008 | Snow |
| 7,389,990 | B2 | 6/2008 | Mourad |
| 7,390,256 | B2 | 6/2008 | Soltys et al. |
| 7,399,226 | B2 | 7/2008 | Mishra |
| 7,407,438 | B2 | 8/2008 | Schubert et al. |
| 7,413,191 | B2 | 8/2008 | Grauzer et al. |
| 7,434,805 | B2 | 10/2008 | Grauzer et al. |
| 7,436,957 | B1 | 10/2008 | Fischer et al. |
| 7,448,626 | B2 | 11/2008 | Fleckenstein |
| 7,458,582 | B2 | 12/2008 | Snow et al. |
| 7,461,843 | B1 | 12/2008 | Baker et al. |
| 7,464,932 | B2 | 12/2008 | Darling |
| 7,464,934 | B2 | 12/2008 | Schwartz |
| 7,472,906 | B2 | 1/2009 | Shai |
| 7,500,672 | B2 | 3/2009 | Ho |
| 7,506,874 | B2 | 3/2009 | Hall |
| 7,510,186 | B2 | 3/2009 | Fleckenstein |
| 7,510,190 | B2 | 3/2009 | Snow et al. |
| 7,510,194 | B2 | 3/2009 | Soltys et al. |
| 7,510,478 | B2 | 3/2009 | Benbrahim et al. |
| 7,513,437 | B2 | 4/2009 | Douglas |
| 7,515,718 | B2 | 4/2009 | Nguyen et al. |
| 7,523,935 | B2 | 4/2009 | Grauzer et al. |
| 7,523,936 | B2 | 4/2009 | Grauzer et al. |
| 7,523,937 | B2 | 4/2009 | Fleckenstein |
| 7,525,510 | B2 | 4/2009 | Beland et al. |
| 7,537,216 | B2 | 5/2009 | Soltys et al. |
| 7,540,497 | B2 | 6/2009 | Tseng |
| 7,540,498 | B2 | 6/2009 | Crenshaw et al. |
| 7,549,643 | B2 | 6/2009 | Quach |
| 7,554,753 | B2 | 6/2009 | Wakamiya |
| 7,556,197 | B2 | 7/2009 | Yoshida et al. |
| 7,556,266 | B2 | 7/2009 | Blaha et al. |
| 7,575,237 | B2 | 8/2009 | Snow |
| 7,578,506 | B2 | 8/2009 | Lambert |
| 7,584,962 | B2 | 9/2009 | Breeding et al. |
| 7,584,963 | B2 | 9/2009 | Krenn et al. |
| 7,584,966 | B2 | 9/2009 | Snow |
| 7,591,728 | B2 | 9/2009 | Gioia et al. |
| 7,593,544 | B2 | 9/2009 | Downs, III et al. |
| 7,594,660 | B2 | 9/2009 | Baker et al. |
| 7,597,623 | B2 | 10/2009 | Grauzer et al. |
| 7,644,923 | B1 | 1/2010 | Dickinson et al. |
| 7,661,676 | B2 | 2/2010 | Smith et al. |
| 7,666,090 | B2 | 2/2010 | Hettinger |
| 7,669,852 | B2 | 3/2010 | Baker et al. |
| 7,669,853 | B2 | 3/2010 | Jones |
| 7,677,565 | B2 | 3/2010 | Grauzer et al. |
| 7,677,566 | B2 | 3/2010 | Krenn et al. |
| 7,686,681 | B2 | 3/2010 | Soltys et al. |
| 7,699,694 | B2 | 4/2010 | Hill |
| 7,735,657 | B2 | 6/2010 | Johnson |
| 7,740,244 | B2 | 6/2010 | Ho |
| 7,744,452 | B2 | 6/2010 | Cimring et al. |
| 7,753,373 | B2 | 7/2010 | Grauzer et al. |
| 7,753,374 | B2 | 7/2010 | Ho |
| 7,753,798 | B2 | 7/2010 | Soltys et al. |
| 7,762,554 | B2 | 7/2010 | Ho |
| 7,764,836 | B2 | 7/2010 | Downs, III et al. |
| 7,766,332 | B2 | 8/2010 | Grauzer et al. |
| 7,766,333 | B1 | 8/2010 | Stardust et al. |
| 7,769,232 | B2 | 8/2010 | Downs, III |
| 7,769,853 | B2 | 8/2010 | Nezamzadeh |
| 7,773,749 | B1 | 8/2010 | Durst et al. |
| 7,780,529 | B2 | 8/2010 | Rowe et al. |
| 7,784,790 | B2 | 8/2010 | Grauzer et al. |
| 7,804,982 | B2 | 9/2010 | Howard et al. |
| 7,846,020 | B2 | 12/2010 | Walker et al. |
| 7,867,080 | B2 | 1/2011 | Nicely et al. |
| 7,890,365 | B2 | 2/2011 | Hettinger |
| 7,900,923 | B2 | 3/2011 | Toyama et al. |
| 7,901,285 | B2 | 3/2011 | Tran et al. |
| 7,908,169 | B2 | 3/2011 | Hettinger |
| 7,909,689 | B2 | 3/2011 | Lardie |
| 7,931,533 | B2 | 4/2011 | LeMay et al. |
| 7,933,448 | B2 | 4/2011 | Downs, III |
| 7,946,586 | B2 | 5/2011 | Krenn et al. |
| 7,967,294 | B2 | 6/2011 | Blaha et al. |
| 7,976,023 | B1 | 7/2011 | Hessing et al. |
| 7,988,152 | B2 | 8/2011 | Sines |
| 7,988,554 | B2 | 8/2011 | LeMay et al. |
| 7,995,196 | B1 | 8/2011 | Fraser |
| 8,002,638 | B2 | 8/2011 | Grauzer et al. |
| 8,011,661 | B2 | 9/2011 | Stasson |
| 8,016,663 | B2 | 9/2011 | Soltys et al. |
| 8,021,231 | B2 | 9/2011 | Walker et al. |
| 8,025,294 | B2 | 9/2011 | Grauzer et al. |
| 8,038,521 | B2 | 10/2011 | Grauzer et al. |
| RE42,944 | E | 11/2011 | Blaha et al. |
| 8,057,302 | B2 | 11/2011 | Wells et al. |
| 8,062,134 | B2 | 11/2011 | Kelly et al. |
| 8,070,574 | B2 | 12/2011 | Grauzer et al. |
| 8,092,307 | B2 | 1/2012 | Kelly |
| 8,092,309 | B2 | 1/2012 | Bickley |
| 8,141,875 | B2 | 3/2012 | Grauzer et al. |
| 8,150,158 | B2 | 4/2012 | Downs, III |
| 8,171,567 | B1 | 5/2012 | Fraser et al. |
| 8,210,536 | B2 | 7/2012 | Blaha et al. |
| 8,221,244 | B2 | 7/2012 | French |
| 8,251,293 | B2 | 8/2012 | Nagata et al. |
| 8,267,404 | B2 | 9/2012 | Grauzer et al. |
| 8,270,603 | B1 | 9/2012 | Durst et al. |
| 8,287,347 | B2 | 10/2012 | Snow et al. |
| 8,287,386 | B2 | 10/2012 | Miller et al. |
| 8,319,666 | B2 | 11/2012 | Weinmann et al. |
| 8,337,296 | B2 | 12/2012 | Grauzer et al. |

(56) References Cited

U.S. PATENT DOCUMENTS 8,342,525 B2 1/2013 Scheper et al.
8,342,526 B1 1/2013 Sampson et al.
8,342,529 B2 1/2013 Snow
8,353,513 B2 1/2013 Swanson
8,381,918 B2 2/2013 Johnson
8,419,521 B2 4/2013 Grauzer et al.
8,444,147 B2 5/2013 Grauzer et al.
8,469,360 B2 6/2013 Sines
8,480,088 B2 7/2013 Toyama et al.
8,485,527 B2 7/2013 Sampson et al.
8,490,973 B2 7/2013 Yoseloff et al.
8,498,444 B2 7/2013 Sharma
8,505,916 B2 8/2013 Grauzer et al.
8,511,684 B2 8/2013 Grauzer et al.
8,556,263 B2 10/2013 Grauzer et al.
8,579,289 B2 11/2013 Rynda et al.
8,616,552 B2 12/2013 Czyzewski et al.
8,628,086 B2 1/2014 Krenn et al.
8,662,500 B2 3/2014 Swanson
8,695,978 B1 4/2014 Ho
8,702,100 B2 4/2014 Snow et al.
8,702,101 B2 4/2014 Scheper et al.
8,720,891 B2 5/2014 Hessing et al.
8,758,111 B2 6/2014 Lutnick
8,777,710 B2 7/2014 Grauzer et al.
8,820,745 B2 9/2014 Grauzer et al.
8,899,587 B2 12/2014 Grauzer et al.
8,919,775 B2 12/2014 Wadds et al.
2001/0036231 A1 11/2001 Easwar et al.
2001/0036866 A1 11/2001 Stockdale et al.
2002/0017481 A1 2/2002 Johnson et al.
2002/0030425 A1 3/2002 Tiramani et al.
2002/0045478 A1 4/2002 Soltys et al.
2002/0045481 A1 4/2002 Soltys et al.
2002/0063389 A1 5/2002 Breeding et al.
2002/0068635 A1 6/2002 Hill
2002/0070499 A1 6/2002 Breeding et al.
2002/0094869 A1 7/2002 Harkham
2002/0107067 A1 8/2002 McGlone et al.
2002/0107072 A1 8/2002 Giobbi
2002/0113368 A1 8/2002 Hessing et al.
2002/0135692 A1 9/2002 Fujinawa
2002/0142820 A1 10/2002 Bartlett
2002/0155869 A1 10/2002 Soltys et al.
2002/0163125 A1 11/2002 Grauzer et al.
2002/0187821 A1 12/2002 Soltys et al.
2002/0187830 A1 12/2002 Stockdale et al.
2003/0003997 A1 1/2003 Vuong et al.
2003/0007143 A1 1/2003 McArthur et al.
2003/0047870 A1 3/2003 Blaha et al.
2003/0048476 A1 3/2003 Yamakawa
2003/0052449 A1 3/2003 Grauzer et al.
2003/0052450 A1 3/2003 Grauzer et al.
2003/0064798 A1 4/2003 Grauzer et al.
2003/0067112 A1 4/2003 Grauzer et al.
2003/0071413 A1 4/2003 Blaha et al.
2003/0073498 A1 4/2003 Grauzer et al.
2003/0075865 A1 4/2003 Grauzer et al.
2003/0075866 A1 4/2003 Blaha et al.
2003/0087694 A1 5/2003 Storch
2003/0090059 A1 5/2003 Grauzer et al.
2003/0094756 A1 5/2003 Grauzer et al.
2003/0151194 A1 8/2003 Hessing et al.
2003/0195025 A1 10/2003 Hill
2004/0015423 A1 1/2004 Walker et al.
2004/0036214 A1 2/2004 Baker et al.
2004/0067789 A1 4/2004 Grauzer et al.
2004/0100026 A1 5/2004 Haggard
2004/0108654 A1 6/2004 Grauzer et al.
2004/0116179 A1 6/2004 Nicely et al.
2004/0169332 A1 9/2004 Grauzer et al.
2004/0180722 A1 9/2004 Giobbi
2004/0224777 A1 11/2004 Smith et al.
2004/0245720 A1 12/2004 Grauzer et al.
2004/0259618 A1 12/2004 Soltys et al.
2005/0012671 A1 1/2005 Bisig
2005/0023752 A1 2/2005 Grauzer et al.
2005/0026680 A1 2/2005 Gururajan
2005/0035548 A1 2/2005 Yoseloff et al.
2005/0037843 A1 2/2005 Wells et al.
2005/0040594 A1 2/2005 Krenn et al.
2005/0051955 A1 3/2005 Schubert et al.
2005/0051956 A1 3/2005 Grauzer et al.
2005/0062227 A1 3/2005 Grauzer et al.
2005/0062228 A1 3/2005 Grauzer et al.
2005/0062229 A1 3/2005 Grauzer et al.
2005/0082750 A1 4/2005 Grauzer et al.
2005/0093231 A1 5/2005 Grauzer et al.
2005/0104289 A1 5/2005 Grauzer et al.
2005/0104290 A1 5/2005 Grauzer et al.
2005/0110210 A1 5/2005 Soltys et al.
2005/0113166 A1 5/2005 Grauzer et al.
2005/0113171 A1 5/2005 Hodgson
2005/0119048 A1 6/2005 Soltys et al.
2005/0121852 A1 6/2005 Soltys et al.
2005/0137005 A1 6/2005 Soltys et al.
2005/0140090 A1 6/2005 Breeding et al.
2005/0146093 A1 7/2005 Grauzer et al.
2005/0148391 A1 7/2005 Tain
2005/0192092 A1 9/2005 Breckner et al.
2005/0206077 A1 9/2005 Grauzer et al.
2005/0242500 A1 11/2005 Downs
2005/0272501 A1 12/2005 Tran et al.
2005/0288083 A1 12/2005 Downs
2005/0288086 A1 12/2005 Schubert et al.
2006/0027970 A1 2/2006 Kyrychenko
2006/0033269 A1 2/2006 Grauzer et al.
2006/0033270 A1 2/2006 Grauzer et al.
2006/0046853 A1 3/2006 Black
2006/0063577 A1 3/2006 Downs et al.
2006/0066048 A1 3/2006 Krenn et al.
2006/0181022 A1 8/2006 Grauzer et al.
2006/0183540 A1 8/2006 Grauzer et al.
2006/0189381 A1 8/2006 Daniel et al.
2006/0199649 A1 9/2006 Soltys et al.
2006/0205508 A1 9/2006 Green
2006/0220312 A1 10/2006 Baker et al.
2006/0220313 A1 10/2006 Baker et al.
2006/0252521 A1 11/2006 Gururajan et al.
2006/0252554 A1 11/2006 Gururajan et al.
2006/0279040 A1 12/2006 Downs et al.
2006/0281534 A1 12/2006 Grauzer et al.
2007/0001395 A1 1/2007 Gioia et al.
2007/0006708 A1 1/2007 Laakso
2007/0015583 A1 1/2007 Tran
2007/0018389 A1 1/2007 Downs
2007/0045959 A1 3/2007 Soltys
2007/0049368 A1 3/2007 Kuhn et al.
2007/0057469 A1 3/2007 Grauzer et al.
2007/0066387 A1 3/2007 Matsuno et al.
2007/0069462 A1 3/2007 Downs et al.
2007/0072677 A1 3/2007 Lavoie et al.
2007/0102879 A1 5/2007 Stasson
2007/0111773 A1 5/2007 Gururajan et al.
2007/0184905 A1 8/2007 Gatto et al.
2007/0197294 A1 8/2007 Gong
2007/0197298 A1 8/2007 Rowe
2007/0202941 A1 8/2007 Miltenberger et al.
2007/0222147 A1 9/2007 Blaha et al.
2007/0225055 A1 9/2007 Weisman
2007/0233567 A1 10/2007 Daly
2007/0238506 A1 10/2007 Ruckle
2007/0259709 A1 11/2007 Kelly et al.
2007/0267812 A1 11/2007 Grauzer et al.
2007/0272600 A1 11/2007 Johnson
2007/0278739 A1 12/2007 Swanson
2007/0290438 A1 12/2007 Grauzer et al.
2008/0006997 A1 1/2008 Scheper et al.
2008/0006998 A1 1/2008 Grauzer et al.
2008/0022415 A1 1/2008 Kuo et al.
2008/0032763 A1 2/2008 Giobbi
2008/0039192 A1 2/2008 Laut
2008/0039208 A1 2/2008 Abrink et al.
2008/0096656 A1 4/2008 LeMay et al.

(56) References Cited

U.S. PATENT DOCUMENTS

| | | | |
|---|---|---|---|
| 2008/0111300 | A1 | 5/2008 | Czyzewski et al. |
| 2008/0113700 | A1 | 5/2008 | Czyzewski et al. |
| 2008/0113783 | A1 | 5/2008 | Czyzewski et al. |
| 2008/0136108 | A1 | 6/2008 | Polay |
| 2008/0143048 | A1 | 6/2008 | Shigeta |
| 2008/0176627 | A1 | 7/2008 | Lardie |
| 2008/0217218 | A1 | 9/2008 | Johnson |
| 2008/0234046 | A1 | 9/2008 | Kinsley |
| 2008/0234047 | A1 | 9/2008 | Nguyen |
| 2008/0248875 | A1 | 10/2008 | Beatty |
| 2008/0284096 | A1 | 11/2008 | Toyama et al. |
| 2008/0303210 | A1 | 12/2008 | Grauzer et al. |
| 2008/0315517 | A1 | 12/2008 | Toyama |
| 2009/0026700 | A2 | 1/2009 | Shigeta |
| 2009/0048026 | A1 | 2/2009 | French |
| 2009/0054161 | A1 | 2/2009 | Schubert et al. |
| 2009/0072477 | A1 | 3/2009 | Tseng |
| 2009/0091078 | A1 | 4/2009 | Grauzer et al. |
| 2009/0100409 | A1 | 4/2009 | Toneguzzo |
| 2009/0104963 | A1 | 4/2009 | Burman et al. |
| 2009/0121429 | A1 | 5/2009 | Walsh |
| 2009/0140492 | A1 | 6/2009 | Yoseloff et al. |
| 2009/0166970 | A1 | 7/2009 | Rosh |
| 2009/0176547 | A1 | 7/2009 | Katz |
| 2009/0179378 | A1 | 7/2009 | Amaitis et al. |
| 2009/0186676 | A1 | 7/2009 | Amaitis et al. |
| 2009/0189346 | A1 | 7/2009 | Krenn et al. |
| 2009/0191933 | A1 | 7/2009 | French |
| 2009/0194988 | A1 | 8/2009 | Wright et al. |
| 2009/0197662 | A1 | 8/2009 | Wright et al. |
| 2009/0224476 | A1 | 9/2009 | Grauzer et al. |
| 2009/0227318 | A1 | 9/2009 | Wright et al. |
| 2009/0227360 | A1 | 9/2009 | Gioia et al. |
| 2009/0250873 | A1 | 10/2009 | Jones |
| 2009/0253478 | A1 | 10/2009 | Walker et al. |
| 2009/0253503 | A1 | 10/2009 | Krise et al. |
| 2009/0267296 | A1 | 10/2009 | Ho |
| 2009/0267297 | A1 | 10/2009 | Blaha et al. |
| 2009/0283969 | A1 | 11/2009 | Tseng |
| 2009/0298577 | A1 | 12/2009 | Gagner et al. |
| 2009/0302535 | A1 | 12/2009 | Ho |
| 2009/0302537 | A1 | 12/2009 | Ho |
| 2009/0312093 | A1 | 12/2009 | Walker et al. |
| 2009/0314188 | A1 | 12/2009 | Toyama et al. |
| 2010/0013152 | A1 | 1/2010 | Grauzer et al. |
| 2010/0038849 | A1 | 2/2010 | Scheper et al. |
| 2010/0048304 | A1 | 2/2010 | Boesen |
| 2010/0069155 | A1 | 3/2010 | Schwartz et al. |
| 2010/0178987 | A1 | 7/2010 | Pacey |
| 2010/0197410 | A1 | 8/2010 | Leen et al. |
| 2010/0234110 | A1 | 9/2010 | Clarkson |
| 2010/0240440 | A1 | 9/2010 | Szrek et al. |
| 2010/0244376 | A1 | 9/2010 | Johnson |
| 2010/0244382 | A1 | 9/2010 | Snow |
| 2010/0252992 | A1 | 10/2010 | Sines |
| 2010/0255899 | A1 | 10/2010 | Paulsen |
| 2010/0276880 | A1 | 11/2010 | Grauzer et al. |
| 2010/0311493 | A1 | 12/2010 | Miller et al. |
| 2010/0311494 | A1 | 12/2010 | Miller et al. |
| 2010/0314830 | A1 | 12/2010 | Grauzer et al. |
| 2010/0320685 | A1 | 12/2010 | Grauzer et al. |
| 2011/0006480 | A1 | 1/2011 | Grauzer et al. |
| 2011/0012303 | A1 | 1/2011 | Kourgiantakis et al. |
| 2011/0024981 | A1 | 2/2011 | Tseng |
| 2011/0052049 | A1 | 3/2011 | Rajaraman et al. |
| 2011/0062662 | A1 | 3/2011 | Ohta et al. |
| 2011/0078096 | A1 | 3/2011 | Bounds |
| 2011/0105208 | A1 | 5/2011 | Bickley |
| 2011/0109042 | A1 | 5/2011 | Rynda et al. |
| 2011/0130185 | A1 | 6/2011 | Walker |
| 2011/0130190 | A1 | 6/2011 | Hamman et al. |
| 2011/0159952 | A1 | 6/2011 | Kerr |
| 2011/0159953 | A1 | 6/2011 | Kerr |
| 2011/0165936 | A1 | 7/2011 | Kerr |
| 2011/0172008 | A1 | 7/2011 | Alderucci |
| 2011/0183748 | A1 | 7/2011 | Wilson et al. |
| 2011/0230268 | A1 | 9/2011 | Williams |
| 2011/0269529 | A1 | 11/2011 | Baerlocher |
| 2011/0272881 | A1 | 11/2011 | Sines |
| 2011/0285081 | A1 | 11/2011 | Stasson |
| 2011/0287829 | A1 | 11/2011 | Clarkson et al. |
| 2012/0015724 | A1 | 1/2012 | Ocko et al. |
| 2012/0015725 | A1 | 1/2012 | Ocko et al. |
| 2012/0015743 | A1 | 1/2012 | Lam et al. |
| 2012/0015747 | A1 | 1/2012 | Ocko et al. |
| 2012/0021835 | A1 | 1/2012 | Keller et al. |
| 2012/0034977 | A1 | 2/2012 | Kammler |
| 2012/0062745 | A1 | 3/2012 | Han et al. |
| 2012/0074646 | A1 | 3/2012 | Grauzer et al. |
| 2012/0091656 | A1 | 4/2012 | Blaha et al. |
| 2012/0095982 | A1 | 4/2012 | Lennington et al. |
| 2012/0161393 | A1 | 6/2012 | Krenn et al. |
| 2012/0175841 | A1 | 7/2012 | Grauzer et al. |
| 2012/0181747 | A1 | 7/2012 | Grauzer et al. |
| 2012/0187625 | A1 | 7/2012 | Downs, III et al. |
| 2012/0242782 | A1 | 9/2012 | Huang |
| 2012/0286471 | A1 | 11/2012 | Grauzer et al. |
| 2012/0306152 | A1 | 12/2012 | Krishnamurty et al. |
| 2013/0020761 | A1 | 1/2013 | Sines et al. |
| 2013/0085638 | A1 | 4/2013 | Weinmann et al. |
| 2013/0099448 | A1 | 4/2013 | Scheper et al. |
| 2013/0109455 | A1 | 5/2013 | Grauzer et al. |
| 2013/0132306 | A1 | 5/2013 | Kami et al. |
| 2013/0228972 | A1 | 9/2013 | Grauzer et al. |
| 2013/0300059 | A1 | 11/2013 | Sampson et al. |
| 2013/0337922 | A1 | 12/2013 | Kuhn et al. |
| 2014/0027979 | A1 | 1/2014 | Stasson et al. |
| 2014/0094239 | A1 | 4/2014 | Grauzer et al. |
| 2014/0103606 | A1 | 4/2014 | Grauzer et al. |
| 2014/0138907 | A1 | 5/2014 | Rynda et al. |
| 2014/0145399 | A1 | 5/2014 | Krenn et al. |
| 2014/0171170 | A1 | 6/2014 | Krishnamurty et al. |
| 2014/0175724 | A1 | 6/2014 | Huhtala et al. |
| 2014/0183818 | A1 | 7/2014 | Czyzewski et al. |
| 2015/0069699 | A1 | 3/2015 | Blazevic |

FOREIGN PATENT DOCUMENTS

| | | | |
|---|---|---|---|
| CA | 2266555 | A1 | 4/1998 |
| CA | 2284017 | A1 | 9/1998 |
| CA | 2612138 | A1 | 12/2006 |
| CN | 101127131 | A | 2/2008 |
| CN | 201139926 | Y | 10/2008 |
| CZ | 24952 | U1 | 2/2013 |
| DE | 672616 | C | 3/1939 |
| DE | 2757341 | A1 | 6/1978 |
| DE | 3807127 | A1 | 9/1989 |
| EP | 777514 | A1 | 2/2000 |
| EP | 1194888 | A1 | 4/2002 |
| EP | 1502631 | A1 | 2/2005 |
| EP | 1713026 | A1 | 10/2006 |
| EP | 2228106 | A1 | 9/2010 |
| EP | 1575261 | B1 | 8/2012 |
| FR | 2375918 | A1 | 7/1978 |
| GB | 337147 | A | 10/1930 |
| GB | 414014 | A | 7/1934 |
| GB | 672616 | A | 5/1952 |
| JP | 10063933 | A | 3/1998 |
| JP | 11045321 | A | 2/1999 |
| JP | 2000251031 | A | 9/2000 |
| JP | 2001327647 | A | 11/2001 |
| JP | 2002165916 | A | 6/2002 |
| JP | 2003250950 | A | 9/2003 |
| JP | 2005198668 | A | 7/2005 |
| JP | 2008246061 | A | 10/2008 |
| WO | 8700764 | A1 | 2/1987 |
| WO | 9221413 | A1 | 12/1992 |
| WO | 9528210 | A1 | 10/1995 |
| WO | 9607153 | A1 | 3/1996 |
| WO | 9710577 | A1 | 3/1997 |
| WO | 9814249 | A1 | 4/1998 |
| WO | 9840136 | A1 | 9/1998 |
| WO | 9943404 | A1 | 9/1999 |
| WO | 9952610 | A1 | 10/1999 |

(56) References Cited

FOREIGN PATENT DOCUMENTS

| | | | |
|---|---|---|---|
| WO | 9952611 | A1 | 10/1999 |
| WO | 0051076 | | 8/2000 |
| WO | 0156670 | A1 | 8/2001 |
| WO | 0205914 | A1 | 1/2002 |
| WO | 2004067889 | A1 | 8/2004 |
| WO | 2004112923 | A1 | 12/2004 |
| WO | 2006031472 | A2 | 3/2006 |
| WO | 2006039308 | A2 | 4/2006 |
| WO | 2008005286 | A2 | 1/2008 |
| WO | 2008006023 | A2 | 1/2008 |
| WO | 2008091809 | A2 | 7/2008 |
| WO | 2009137541 | A2 | 11/2009 |
| WO | 2010001032 | A1 | 1/2010 |
| WO | 2010055328 | A1 | 5/2010 |
| WO | 2010117446 | | 10/2010 |
| WO | 2013019677 | | 2/2013 |

OTHER PUBLICATIONS

VendingData Corporation's Responses to Shuffle Master, Inc.'s First set of interrogatories for *Shuffler Master, Inc.* vs. *VendingData Corporation*, In the U.S. District Court, District of Nevada, No. CV-S-04-1373-JCM-LRL, Mar. 14, 2005.
"ACE, Single Deck Shuffler," Shuffle Master, Inc., (2005), 2 pages.
"Automatic casino card shuffle," Alibaba.com, (last visited Jul. 22, 2014), 2 pages.
"Error Back propagation," http://willamette.edu~gorr/classes/cs449/backprop.html (4 pages), Nov 13, 2008.
"i-Deal," Bally Technologies, Inc., (2014), 2 pages.
"Shufflers—SHFL entertainment," Gaming Concepts Group, (2012), 6 pages.
"TAG Archives: Shuffle Machine," Gee Wiz Online, (Mar. 25, 2013), 4 pages.
1/3" B/W CCD Camera Module EB100 by EverFocus Electronics Corp., Jul. 31, 2001, 3 pgs.
Canadian Office Action for CA 2,580,309 dated Mar. 20, 2012 (6 pages).
Christos Stergiou and Dimitrios Siganos, "Neural Networks," http://www.doc.ic.ac.uk/~nd/surprise_96/journal/vol4/cs11/report.html (13 pages), Dec. 15, 2011.
European Patent Application Search Report—European Patent Application No. 06772987.1, Dec. 21, 2009.
Genevieve Orr, CS-449: Neural Networks Willamette University, http://www.willamette.edu/~gorr/classes/cs449/intro.html (4 pages), Fall 1999.
http://www.google.com/search?tbm=pts &q=Card+handling+devicve+with+input+and+outpu . . . Jun. 8, 2012.
http://www.google.com/search?tbm=pts &q=shuffling+zone+onOopposite+site+of+input+. . . Jul. 18, 2012.
Litwiller, Dave, CCD vs. CMOS: Facts and Fiction reprinted from Jan. 2001 Issue of Photonics Spectra, Laurin Publishing Co. Inc. (4 pages).
Malaysian Patent Application Substantive Examination Adverse Report—Malaysian Patent Application Serial No. PI 20062710, Sep. 6, 2006.
PCT International Preliminary Examination Report for corresponding International Application No. PCT/US02/31105 filed Sep. 27, 2002.
PCT International Preliminary Report on Patentability of the International Searching Authority for PCT/US05/31400, dated Oct. 16, 2007, 7 pages.
PCT International Search Report and Written Opinion—International Patent Application No. PCT/US2006/22911, Dec. 28, 2006.
PCT International Search Report and Written Opinion for International Application No. PCT/US2007/023168, dated Sep. 12, 2008, 8 pages.
PCT International Search Report and Written Opinion for International Application No. PCT/US2007/022858, mailed Apr. 18, 2008, 7 pages.
PCT International Search Report and Written Opinion for PCT/US07/15036, dated Sep. 23, 2008, 3 pages.
PCT International Search Report and Written Opinion for PCT/US07/15035, dated Sep. 29, 2008, 3 pages.
PCT International Search Report and Written Opinion of the International Searching Authority for PCT/GB2011/051978, dated Jan. 17, 2012, 11 pages.
PCT International Search Report and Written Opinion of the International Searching Authority for PCT/IB2013/001756, dated Jan. 10, 2014, 7 pages.
PCT International Search Report and Written Opinion of the International Searching Authority for PCT/US11/59797, dated Mar. 27, 2012, 14 pages.
PCT International Search Report and Written Opinion of the International Searching Authority for PCT/US13/59665, dated Apr. 25, 2014, 21 pages.
PCT International Search Report and Written Opinion of the International Searching Authority for PCT/US2008/007069, dated Sep. 8, 2008, 10 pages.
PCT International Search Report and Written Opinion of the International Searching Authority for PCT/US2010/001032, dated Jun. 16, 2010, 11 pages.
PCT International Search Report and Written Opinion, PCT Application No. PCT/US2013/062391, Dec. 17, 2013, 13 pages.
PCT International Search Report and Written Opinion, PCT/US12/48706, Oct. 16, 2012, 12 pages.
PCT International Search Report for International Application No. PCT/US2003/015393, mailed Oct. 6, 2003.
PCT International Search Report for PCT/US2005/034737 dated Apr. 7, 2006 (WO06/039308).
PCT International Search Report for PCT/US2007/022894, dated Jun. 11, 2008, 2 pages.
PCT International Search Report and Written Opinion of the International Searching Authority for PCT/US05/31400, dated Sep. 25, 2007, 8 pages.
PCT International Search Report and Written Opinion, PCT Application No. PCT/US2015/022158, Jun. 17, 2015, 13 pages.
Philippines Patent Application Formality Examination Report—Philippines Patent Application No. 1-2006-000302, Jun. 13, 2006.
Press Release for Alliance Gaming Corp., Jul. 26, 2004—Alliance Gaming Announces Control with Galaxy Macau for New MindPlay Baccarat Table Technology, http://biz.yahoo.com/prnews.
Scarne's Encyclopedia of Games by John Scarne, 1973, "Super Contract Bridge", p. 153.
Service Manual/User Manual for Single Deck Shufflers: BG1, BG2 and BG3 by Shuffle Master ©1996.
Shuffle Master Gaming, Service Manual, ACETM Single Deck Card Shuffler, (1998), 63 pages.
Shuffle Master Gaming, Service Manual, Let It Ride Bonus® With Universal Keypad, 112 pages, © 2000 Shuffle Master, Inc.
Shuffle Master's Reply Memorandum in Support of Shuffle Master's Motion for Preliminary Injunction for *Shuffle Master, Inc.* vs. *VendingData Corporation*, In the U.S. District Court, District of Nevada, No. CV-S-04-1373-JCM-LRL, Nov. 29, 2004.
Singapore Patent Application Examination Report—Singapore Patent Application No. SE 2008 01914 A, Aug. 6, 2006.
Specification of Australian Patent Application No. 31577/95, filed Jan. 17, 1995, Applicants: Rodney G. Johnson et al., Title: Card Handling Apparatus.
Specification of Australian Patent Application No. Not Listed, filed Aug. 15, 1994, Applicants: Rodney G. Johnson et al., Title: Card Handling Apparatus.
Statement of Relevance of Cited References, Submitted as Part of a Third-Party Submission Under 37 CFR 1.290 on Dec. 7, 2012 (12 pages).
tbm=pts&hl=en Google Search for card handling device with storage area, card removing system pivoting arm and processor . . . ; http://www.google.com/?tbrn=pts&hl=en; Jul. 28, 2012.
Tracking the Tables, by Jack Bularsky, Casino Journal, May 2004, vol. 17, No. 5, pp. 44-47.

(56) References Cited

OTHER PUBLICATIONS

United States Court of Appeals for the Federal Circuit Decision Decided Dec. 27, 2005 for Preliminary Injuction for *Shuffle Master, Inc.* vs. *VendingData Corporation*, In the U.S. District Court, District of Nevada, No. CV-S-04-1373- JCM-LRL.

VendingData Corporation's Answer and Counterclaim Jury Trial Demanded for *Shuffle Master, Inc.* vs. *VendingData Corporation*, In the U.S. District Court, District of Nevada, No. CV-S-04-1373-JCM-LRL, Oct. 25, 2004.

DVD Labeled "Luciano Decl. Ex. K". This is the video taped live Declaration of Mr. Luciano (see list of patents on the 1449 or of record in the file history) taken during preparation of litigation (Oct. 23, 2003). DVD sent to Examiner by US Postal Service with this PTO/SB/08 form.

DVD labeled Morrill Decl. Ex. A:. This is the video taped live Declaration of Mr. Robert Morrill, a lead trial counsel for the defense, taken during preparation for litigation. He is describing the operation of the Roblejo Prototype device. See Roblejo patent in 1449 or of record (Jan. 15, 2004). DVD sent to Examiner by US Postal Service with this PTO/SB/08 form.

DVD Labeled "Solberg Decl. Ex. C". Exhibit C to Declaration of Hal Solberg, a witness in litigation, signed Dec. 1, 2003. DVD sent to Examiner by US Postal Service with this PTO/SB/08 form.

DVD labeled "Exhibit 1". This is a video taken by Shuffle Master personnel of the live operation of a CARD One2Six™ Shuffler (Oct. 7, 2003). DVD sent to Examiner by US Postal Service with this PTO/SB/08 form.

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 1 of 23 (Master Index and Binder 1, 1 of 2).

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 2 of 23 (Master Index and Binder 1, 2 of 2).

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 3 of 23 (Binder 2, 1 of 2).

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 4 of 23 (Binder 2, 2 of 2).

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 5 of 23 (Binder 3, 1 of 2).

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 6 of 23 (Binder 3, 2 of 2).

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 7 of 23 (Binder 4, 1 of 2).

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 8 of 23 (Binder 4, 2 of 2).

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 9 of 23 (Binder 5 having no contents; Binder 6, 1 of 2).

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 10 of 23 (Binder 6, 2 of 2).

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 11 of 23 (Binder 7, 1 of 2).

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 12 of 23 (Binder 7, 2 of 2).

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 13 of 23 (Binder 8, 1 of 5).

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 14 of 23 (Binder 8, 2 of 5).

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 15 of 23 (Binder 8, 3 of 5).

Documents submitted in the case of *Shuffle Master, Inc.* v. *Card Austria, et al.* Case No. CV-N-0508-HDM-(VPC) (Consolidated with Case No. CV-N-02-0244-ERC-(RAM)), May 6, 2003, Part 16 of 23 (Binder 8, 4 of 5).

Documents submitted in the case of *Shuffle Master, Inc.* v. *Card Austria, et al.,* Case No. CV-N-0508-HDM-(VPC) (Consolidated with Case No. CV-N-02-0244-ERC-(RAM)), May 6, 2003, Part 17 of 23 (Binder 8, 5 of 5).

Documents submitted in case of *Shuffle Master, Inc.* v. *Card Austria, et al.,* Case No. CV-N-0508-HDM-(VPC) Consolidated with Case No. CV-N-02-0244-ERC-(RAM)), May 6, 2003, scan of color pages, for clarity, Part 18 of 23 (color copies from Binder 1).

Documents submitted in case of *Shuffle Master, Inc.* v. *Card Austria, et al.,* Case No. CV-N-0508-HDM-(VPC) Consolidated with Case No. CV-N-02-0244-ERC-(RAM)), May 6, 2003, scan of color pages, for clarity, Part 19 of 23 (color copies from Binder 3).

Documents submitted in case of *Shuffle Master, Inc.* v. *Card Austria, et al.,* Case No. CV-N-0508-HDM-(VPC) Consolidated with Case No. CV-N-02-0244-ERC-(RAM)), May 6, 2003, scan of color pages, for clarity, Part 20 of 23 (color copies from Binder 4).

Documents submitted in case of *Shuffle Master, Inc.* v. *Card Austria, et al.,* Case No. CV-N-0508-HDM-(VPC) Consolidated with Case No. CV-N-02-0244-ERC-(RAM)), May 6, 2003, scan of color pages, for clarity, Part 21 of 23 (color copies from Binder 6).

Documents submitted in case of *Shuffle Master, Inc.* v. *Card Austria, et al.,* Case No. CV-N-0508-HDM-(VPC) Consolidated with Case No. CV-N-02-0244-ERC-(RAM)), May 6, 2003, scan of color pages, for clarity, Part 22 of 23 (color copies from Binder 8, part 1 of 2).

Documents submitted in case of *Shuffle Master, Inc.* v. *Card Austria, et al.,* Case No. CV-N-0508-HDM-(VPC) Consolidated with Case No. CV-N-02-0244-ERC-(RAM)), May 6, 2003, scan of color pages, for clarity, Part 23 of 23 (color copies from Binder 8, part 2 of 2).

PLAYING CARD HANDLING DEVICES, SYSTEMS, AND METHODS FOR VERIFYING SETS OF CARDS

TECHNICAL FIELD

The disclosure relates generally to playing card-handling devices and systems, such as shufflers, dealing shoes, and combinations thereof.

BACKGROUND

Games such as poker, baccarat, and blackjack use playing cards that have been randomized. Historically, playing cards were manually shuffled by a dealer or a player. Most casinos or other gaming establishments currently employ the use of mechanical automatic shufflers to randomize the cards. Automatic shufflers generally provide a higher level of randomization and security against cheating or mistakes compared to manual shuffling. However, players and dealers have been known to cheat or make mistakes that may lead to one or more improper or unauthorized cards being introduced into a set of cards used in a particular game. For example, cards from another set may be inadvertently mixed with a set of cards being used, or a cheating player may attempt to introduce a card that is advantageous to the cheating player into the set of cards being used. Thus, true randomization of the cards may be compromised and the cheating player may gain an advantage. Even if the unauthorized card is introduced into a set of cards by mistake, the fairness of the game may be reduced. Various security measures have been implemented to reduce the occurrence of such mistakes and cheating.

For example, prior known playing cards have been provided with enhanced security features. In one example, a transponder is positioned within the card body and is encoded with permanent read-only identification information as well as a data bank for receiving and maintaining changeable information transmitted thereto from an RF antenna, as described in U.S. Pat. No. 8,221,244, filed Nov. 14, 2008, titled "Table with Sensors and Smart Card Holder for Automated Gaming System and Gaming Cards" (hereinafter "the '244 patent"). The changeable information may include a transactional history of the card during a game, to reduce disputes regarding the history of a game and/or reduce various types of fraud and/or mistakes.

BRIEF SUMMARY

In some embodiments, the present disclosure includes systems for handling and verifying sets of cards. Such systems may include an automatic card shuffler and a shoe. The automatic card shuffler may include a card-shuffling mechanism configured to shuffle a set of cards, a shuffler processor programmed to randomly select a set symbol, and a printing device for applying the randomly selected set symbol to each card in the set of cards prior to removal of the set of cards from the automatic card shuffler. The shoe may include a receptacle for receiving the set of cards from the automatic card shuffler, a set symbol reader for reading each card of the set of cards for a presence and identity of a set symbol, and a shoe processor configured to receive a signal from the shuffler processor indicating the selected set symbol and configured to verify that each card of the set of cards includes a set symbol matching the selected set symbol.

In other embodiments, the present disclosure includes methods for verifying that cards to be removed from a card-handling device belong to a particular set of cards. In accordance with such methods, a randomly determined set symbol may be formed on each card in the particular set of cards with a first card-handling device. A signal representing the randomly determined set symbol may be transmitted with a data transmission device of the first card-handling device to a second card-handling device. The particular set of cards may be transferred from the first card-handling device to the second card-handling device. The methods may include detecting with the second card-handling device whether each card therein includes a set symbol matching the randomly determined set symbol. When a card does not include a set symbol matching the randomly determined set symbol, a signal may be provided indicating that a card does not belong to the particular set of cards.

In other embodiments, the present disclosure includes automatic card shufflers. Such automatic card shufflers may include a card infeed tray, a card-shuffling mechanism, and a card output tray. A processor may be programmed to randomly select a card set symbol to form on each card in a set of cards. The automatic card shufflers may include a card-marking system for forming the randomly selected set symbol on each card received in the card infeed tray prior to delivery of each card to the card output tray and a card-reading device for reading set symbols on cards delivered to the card output tray. The card-reading device may be in information communication with the processor, and the processor may be configured to generate a signal indicating a delivered card does not include a set symbol matching the randomly selected set symbol.

BRIEF DESCRIPTION OF THE DRAWINGS

While the disclosure concludes with claims particularly pointing out and distinctly claiming embodiments of the invention, various features and advantages of embodiments of the invention may be more readily ascertained from the following description when read in conjunction with the accompanying drawings, in which:

DETAILED DESCRIPTION

Figure 1:
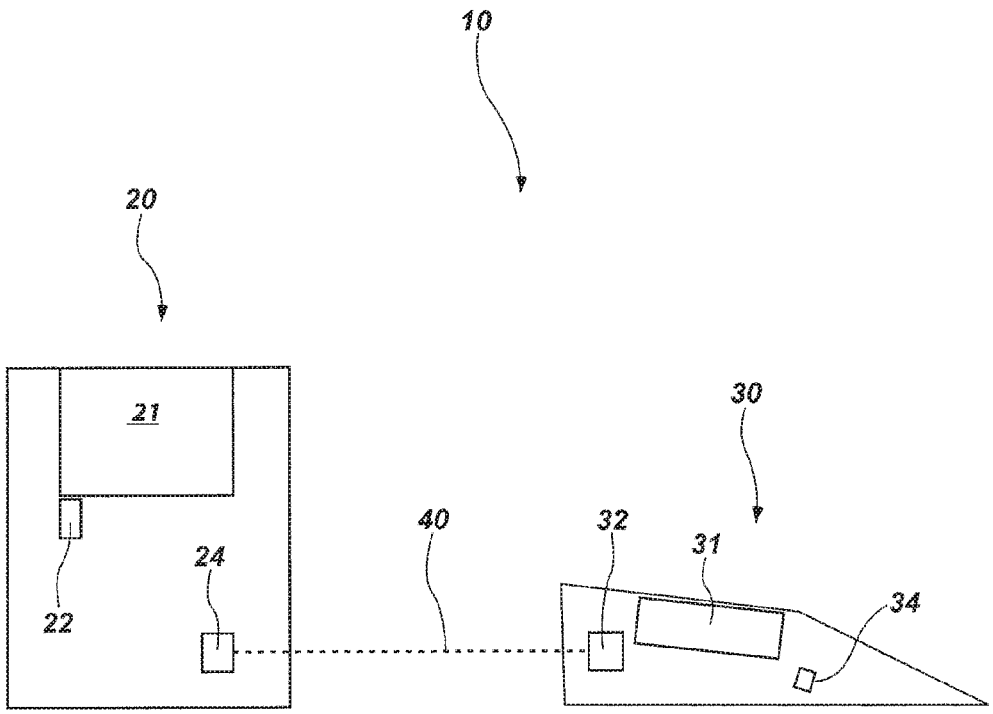
FIG. 1 is a simplified block diagram of a card-handling system according to an embodiment of the present disclosure.

The illustrations presented herein are not meant to be actual views of any particular system, device, or component thereof, but are merely idealized representations employed to describe illustrative embodiments. Thus, the drawings are not necessarily drawn to scale. Additionally, elements common between figures may retain the same or similar numerical designation.

As used herein, the term "invisible" in relation to ink or a symbol means imperceptible or unreadable to the unaided human eye. The visible spectrum is between about 390 nm and about 700 nm, which corresponds to a band of electromagnetic radiation between about 430 THz and about 790 THz for purposes of this disclosure. Invisible light is light outside of the visible spectrum. Invisible ink or an invisible symbol may be invisible to the human eye, but perceptible and readable to a reading device. An invisible symbol, for purposes of this disclosure, also includes symbols that are only perceptible to the human eye under magnification. In addition, an invisible symbol may appear to an unaided human eye as a visible line or other mark, but may include information, such as in the form of micro-script, that cannot be perceived or read by the unaided human eye.

As used herein, the term "printing" in relation to printing a symbol on a card means forming any identifier on or in the card. In some embodiments, printing may include applying a material, such as visible or invisible ink, wax, paint, or toner, to the card. In some embodiments, printing may include forming an identifier without any ink, such as by scratching the card, engraving the card, ablating material from the card, burning a portion of the card, embossing (i.e., forming a raised portion on) the card, sputtering, deposition, or debossing (i.e., forming indentations or recesses in) the card, for example.

As used herein, the phrase "card-handling device" means a mechanical or electromechanical device for handling cards. Non-limiting examples of card-handling devices include automatic card shufflers, card counters, card-dealing shoes, card storage devices, card verification devices, card-printing devices, card readers, and devices for performing any combination of functions thereof.

Embodiments of the present disclosure include systems including a first card-handling apparatus and a second card-handling apparatus. The first card-handling apparatus may be configured to print a randomly selected set symbol on each card of a set of cards. The set of cards may be transferred to the second card-handling apparatus, which may be configured to determine whether each of the cards therein includes a set symbol matching the randomly selected set symbol. The first and second card-handling apparatuses may be parts of a single device (e.g., a shuffling mechanism and an output tray), or may be separate devices (e.g., a card shuffler and a separate dealing shoe). In some embodiments, the shoe may be removably coupled to the shuffler or aligned with the shuffler such that cards may be automatically loaded into the shoe. If the first and second card-handling apparatuses are separate devices, a communication link may exist to enable the first card-handling apparatus to transmit a signal to the second card-handling apparatus indicating the randomly selected set symbol. The second card-handling device may receive the signal and compare the expected randomly selected set symbol with information (e.g., an image or other data) gathered from each card by a reading device. The systems of the present disclosure may provide improved security and fairness in playing card games by verifying that each card being dealt to players belongs to the proper set of cards. Thus, cheating or errors may be identified in which a card initially belonging to a different set is introduced into the set of cards being used.

As shown in FIG. 1, a card-handling system 10 of the present disclosure includes an automatic card shuffler 20 and a shoe 30. The automatic card shuffler 20 may be configured to shuffle (e.g., randomize) a set of cards with a card-shuffling mechanism 21. A printing device 22 may be configured to apply a randomly selected set symbol to each card in the set of cards prior to removal from the automatic card shuffler 20. A shuffler processor 24 may be configured (e.g., programmed) to randomly select a set symbol to be printed on each card of the set of cards with the printing device 22, for subsequent verification that each card belongs to the set of cards. Details of example embodiments suitable for use as the automatic card shuffler 20 and components thereof (e.g., the card-shuffling mechanism 21, the printing device 22, the processor 24) will be described below with reference to FIGS. 2, 3, 6, and 7.

The shoe 30 may include a receptacle 31 for receiving the set of cards from the automatic card shuffler 20 after the set of cards is shuffled and after the randomly selected set symbol is printed on each card of the set of cards by the printing device 22. The cards may be manually or automatically loaded. The shoe 30 may include a shoe processor 32 configured to receive a signal from the shuffler processor 24 indicating the randomly selected set symbol printed on each card of the set of cards, such as through a data connection 40. By way of example and not limitation, the data connection 40 may be a wireless connection, a hard wired connection, a data bus, a table system network, a local area network, a wide area network, a wireless network, or a cell phone network. The shoe 30 may also include a set symbol reader 34 for reading set symbols applied to each card of the set of cards. The shoe processor 32 may be configured to receive an image or other information from the set symbol reader 34 and to determine whether each card read by the set symbol reader 34 includes a set symbol matching the randomly selected set symbol. Accordingly, the shoe processor 32 may be configured to verify that each card belongs to the set of cards received from the automatic card shuffler 20 and to identify cards that do not belong to the set of cards (e.g., unauthorized cards inadvertently or purposely positioned within the receptacle 31). Details of example embodiments suitable for use as the shoe 30 and components thereof (e.g., the receptacle 31, the processor 32, the set symbol reader 34) will be described below with reference to FIGS. 4, 5, 6, and 7.

Figure 2:
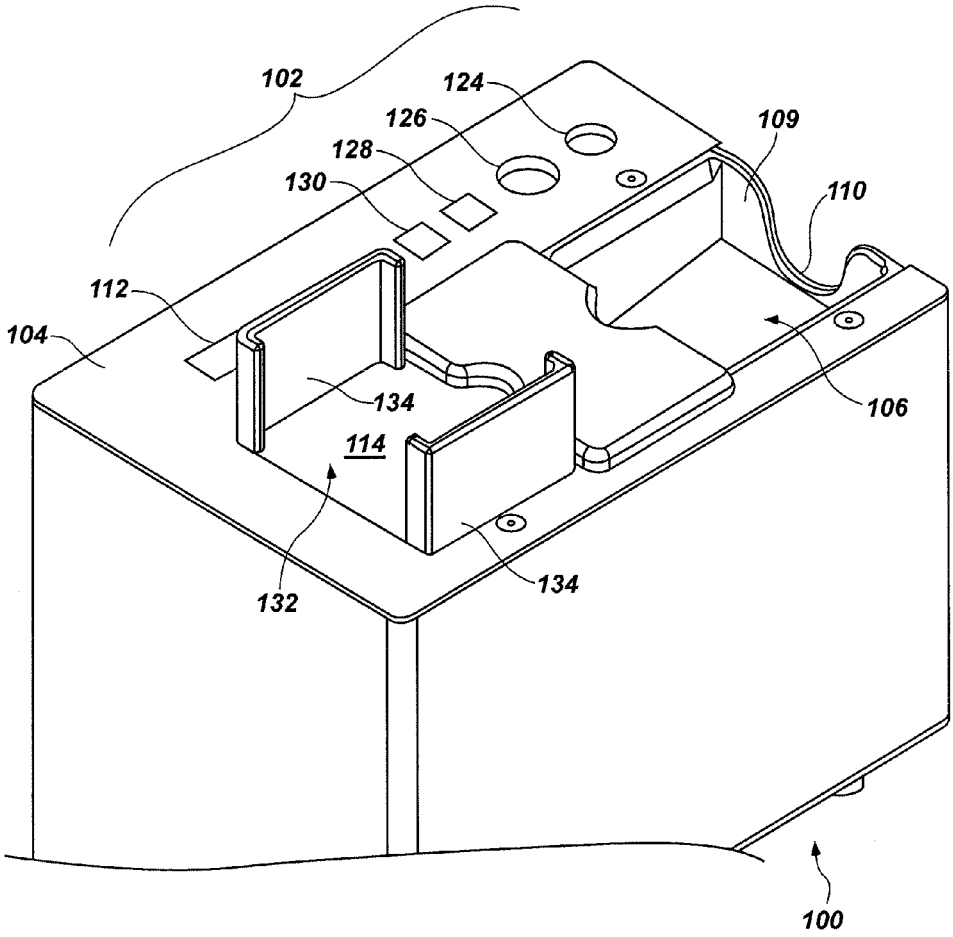
FIG. 2 is a partial perspective view of a card-handling device according to an embodiment of the present disclosure.

FIG. 2 is a partial perspective view of a card-handling device 100 according to an embodiment of the present disclosure, which may be used as the automatic card shuffler 20 of the card-handling system 10 of FIG. 1. The card-handling device 100 includes a card-receiving area 106 that may be provided with a stationary lower support surface that slopes downwardly from an outer side 109 of the card-handling device 100. The outer side 109 may include a depression 110 configured to facilitate an operator's ability to place or remove cards into the card-receiving area 106. A top surface 104 of a main body of the card-handling device 100 may include a user interface 102 that may include a visual display 112 (e.g., a light-emitting diode (LED), liquid crystal, micro monitor, or semiconductor display) and one or more user inputs 124, 126. The user inputs 124, 126 may include one or more buttons, touch screens, levers, knobs, etc. The user interface 102 may further include lights and/or displays 128, 130, which may be configured to indicate a power availability (on/off), a shuffler state (e.g., active shuffling, completed shuffling cycle, insufficient numbers of cards, missing cards, sufficient numbers of cards, complete deck(s), damaged or marked cards, entry functions for the dealer to identify the number of players, the number of cards per hand, access to fixed programming for various games, the number of decks being shuffled, card calibration information, etc.), or other information useful to the operator.

The card-handling device 100 may further include a shuffled card return area 132. The shuffled card return area 132 may include an elevator surface 114 and card-supporting sides 134 that surround at least a portion of the elevator surface 114. In some embodiments, the card-supporting sides 134 remain fixed to the elevator surface 114 during operation. In other embodiments, the card-supporting sides 134 may be fixed to the frame and do not move with the elevator surface 114. In some embodiments, the card-supporting sides 134 may be removable. Removal of the card-supporting sides 134 may enable the operator to lift a shuffled set of cards onto a gaming table surface or to carry a shuffled set of cards to a dealing shoe for use in a card game. In some embodiments, the card-supporting sides 134 may act as a cassette for carrying the shuffled cards to a location remote from the card-handling device 100. Additional details regarding such a card-handling device are described in U.S. Pat. No. 7,764,836, issued Jul. 27, 2010, and entitled "Card Shuffler with Card Rank and Value Reading Capability Using CMOS Sensor," the disclosure of which is incorporated herein in its entirety by this reference. Internally, the card-handling device 100 may further include a processor 152 (FIG. 3) configured in hardware and/or software for randomly selecting a symbol to be printed on a set of cards and a printing device 150 (FIG. 3) for printing the randomly selected symbol on each card of the set, as will be described in further detail below.

Figure 3:
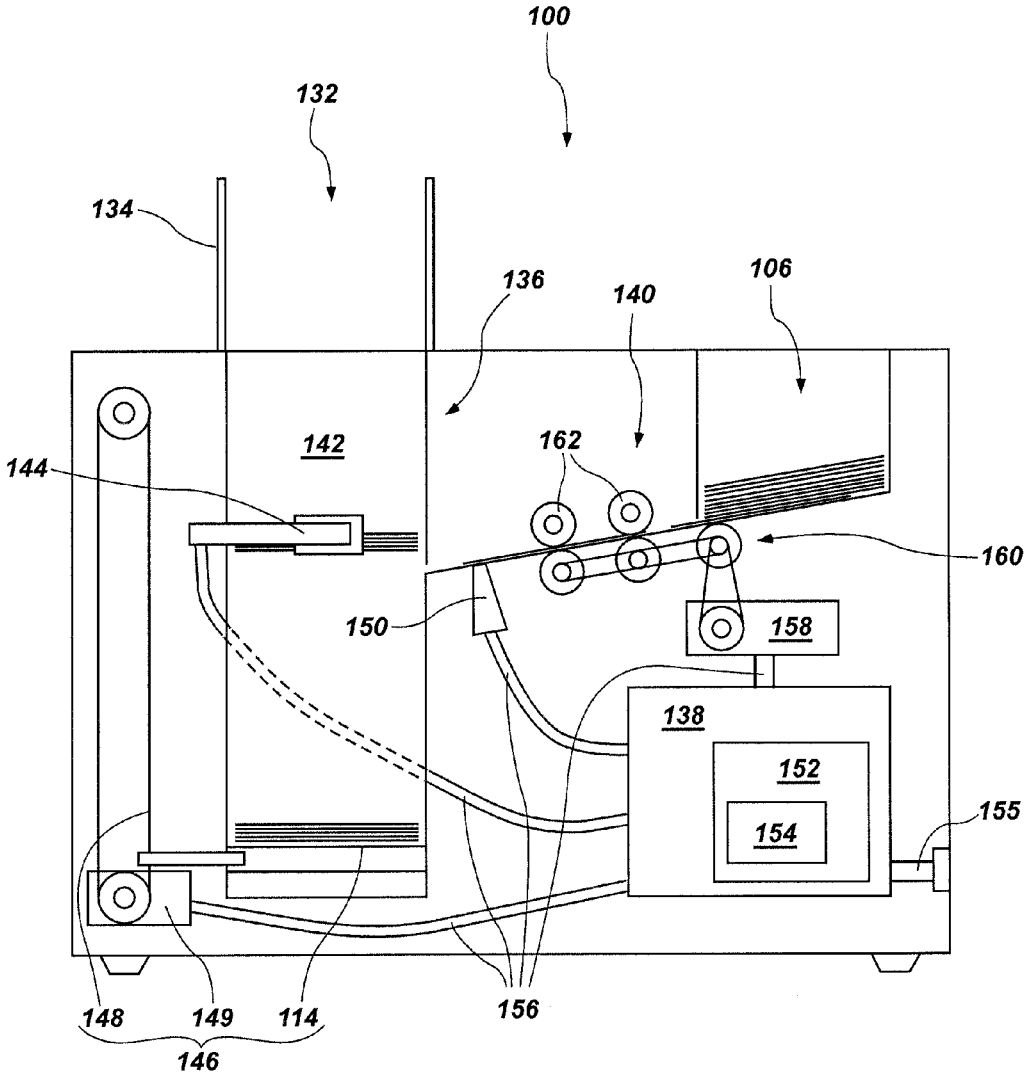
FIG. 3 is a simplified side view of internal components of the card-handling device of FIG. 2.

FIG. 3 illustrates a simplified view of internal components of the card-handling device 100 of FIG. 2. The card-handling device 100 shown in FIG. 3 and described herein is an automatic card shuffler 100, although embodiments of the present disclosure may be implemented in other card-handling devices, such as card verification devices. The automatic card shuffler 100 may include a shuffling mechanism 136, an electrical control unit 138, a card-moving mechanism 140, and a marking or printing device 150. By way of example and not limitation, the shuffling mechanism 136 may include a shuffling chamber 142, one or more grippers 144, and an elevator 146. The elevator 146 may include the elevator surface 114, an elevator belt 148, and an elevator motor 149. At least one processor 152 of the electrical control unit 138 may include a random number generator (RNG) 154. The RNG 154 may be implemented in hardware and/or software. In other embodiments, the RNG 154 may be separate from the at least one processor 152. The at least one processor 152 may be configured to process inputs and data and to control the various components of the automatic card shuffler 100. A data connection 155 (e.g., a data line, a wired transmission line or device, a wireless transmission device) may be configured to transmit data (e.g., the identity of a randomly selected set symbol) from the automatic card shuffler 100 to another card-handling device, such as a dealing shoe 200 described below with reference to FIGS. 4 and 5, for example. The electrical control unit 138 may be configured to control the shuffling mechanism 136, the card-moving mechanism 140, and the printing device 150, such as by sending electrical signals to such components through wires 156. The card-moving mechanism 140 may include a roller motor 158, lower powered rollers 160, and upper unpowered rollers 162.

During operation, each card may have a randomly selected set symbol applied (e.g., printed) thereon by the printing device 150. The randomly selected set symbol may be selected using the RNG 154 of the electrical control unit 138 prior to a first card of the set of cards being moved into the shuffling mechanism 136. The printing device 150 may print the same randomly selected set symbol on each card of the set of cards, such that every card of a particular set of cards handled by the automatic card shuffler 100 has the same randomly selected set symbol printed thereon. When a new set of cards is positioned within the card-receiving area 106 to be randomized by the automatic card shuffler 100, a new set symbol may be randomly selected to be printed on each card of the new set of cards. Thus, the randomly selected set symbol may provide a random and unique identifier for each set of cards randomized by the automatic card shuffler 100.

Any symbol that is capable of being printed on the cards and uniquely recognized by a reading device may be used as the randomly selected set symbol. For example, the randomly selected set symbol to be printed on each card of the set of cards may include one or more of the following: a random sequence of numbers; a random sequence of letters; a random sequence of special characters, such as punctuation marks, mathematical symbols, and other symbols including "~," "@," "#," "$," "%," "^," "&," and "*," for example; a random bar code; a random dot matrix code; a random pictograph or sequence of pictographs; and a random sequence of foreign language symbols (e.g., Asian language characters, Greek language letters, Arabic language symbols, combinations thereof). Any randomly selected symbol capable of application onto each card in the set and then symbol reading by a reader 202 (FIGS. 4 and 5) is suitable for use with embodiments of the present disclosure.

The printing device 150 may include any device capable of printing the randomly selected set symbol on cards. By way of example and not limitation, the printing device 150 may be similar or identical to printing devices used to print expiration dates on food or beverage containers. By way of further example, the printing device 150 may be or include a bar code printer, a dot matrix printer, an ink jet printer, a laser printer, an embosser, a debosser, a scratching device, a laser ablation device, a stamp, a nano-marking device, or any of the print heads described in U.S. Pat. No. 7,390,256, filed Dec. 13, 2001, titled "Method, Apparatus and Article for Random Sequence Generation and Playing Card Distribution," the disclosure of which is incorporated herein in its entirety by this reference. In another example, the printing device 150 may be positioned and configured to print a bar code along side edges of the cards when the cards are positioned in a stack, such as an initial stack of cards in the card-receiving area 106 or a randomized stack of cards in the shuffling mechanism 136. The printing device 150 may be configured to apply visible ink, invisible ink, or no ink to the card. If no ink is used, the printing device 150 may be configured to print the selected set symbol on the cards by removing material of the card, such as by scratching the card, engraving the card, or ablating material (e.g., a polymer or wax coating) from the card, by burning a portion of the card, by embossing (i.e., forming raised portions on) the card, or by debossing (i.e., forming indentations or recesses in) the card, for example.

In some embodiments, the card-moving mechanism 140 may be stopped when a card is in a position for printing the selected set symbol thereon by the printing device 150. In other embodiments, the printing device 150 may be configured to print the selected symbol on the card while the card is moving from the card-receiving area 106 toward the shuffling mechanism 136.

To randomize the set of cards, the RNG 154 (or another RNG) may select a random number of cards to be suspended by the one or more grippers 144, the random number selected from the set of numbers between and including zero and the number of cards present within the shuffling chamber 142. The elevator surface 114 may be raised to an appropriate level to position the random number of cards at the level of the one or more grippers 144. Next, the one or more grippers 144 may grip and suspend the random number of the cards in the shuffling chamber 142, after which the elevator surface 114 with or without cards thereon may be lowered to form a gap below the cards suspended by the one or more grippers 144. A card from the card-receiving area 106 and including the selected set symbol printed thereon may be inserted into the gap, the elevator surface 114 raised, and the one or more grippers 144 may be released to enable the previously suspended cards to be supported by the elevator surface 114. To continue the randomization of the set of cards, the elevator position may be moved to another random location, and the one or more grippers 144 may again grip and suspend another random number of cards to form another gap, and another card may be inserted into the newly formed gap. Such operations may be repeated until every card initially present in the card-receiving area 106 has been randomly positioned within the shuffling chamber 142. The randomized set of cards stacked on the elevator surface 114 may then be raised by the elevator 146 to the shuffled card return area 132 for removal from the automatic card shuffler 100.

As noted above, the cards may or may not be stopped to enable the printing device 150 to print the randomly selected set symbol on each card. In some embodiments, the time it takes to print the randomly selected set symbol may be about the same time or less time compared to the time it takes to form a new gap in the shuffling mechanism 136 for insertion of the card being printed. Accordingly, operation of the printing device 150 may have little, if any, impact on the overall operation speed of the automatic card shuffler 100. In other embodiments, such as when the selected printing device 150 operates relatively slower than the shuffling mechanism 136, the printing may lengthen the time the automatic card shuffler 100 can produce a randomized set of cards. However, the benefits of added security (discussed in more detail below) enabled by the presence of the randomly selected set symbol on each of the cards may outweigh any drawback of additional processing time. In some embodiments, the user interface 102 (FIG. 2) may include an input for disabling the printing device 150, such as when the benefits of randomization speed outweigh the benefits of printing a randomly selected set symbol on cards to be randomized or when the automatic card shuffler 100 is to be used simply to randomize a set of cards.

Although FIG. 3 has been described as including a particular shuffling mechanism 136 that includes one or more grippers 144 and an elevator 146, other shuffling mechanisms may be used in embodiments of the present disclosure. For example, the printing device 150 may be used to print a randomly selected set symbol on cards being shuffled by any of a riffling mechanism, a circular carousel of slots, a linear stack of slots, a random ejection unit, and any other known shuffling mechanism. Accordingly, the present disclosure is not limited by the specific configuration or type of shuffling mechanism used. In addition, the printing device 150 may be positioned within the automatic card shuffler 100 relative to the shuffling mechanism 136 to print a randomly selected set symbol on cards prior to the cards entering the shuffling mechanism 136, while the cards are within the shuffling mechanism 136, or after the cards are removed from the shuffling mechanism 136. Such options for positioning the printing device 150 may be selected by one of ordinary skill in the art given the type and configuration of the particular shuffling mechanism used and based upon space and/or design constraints of the automatic card shuffler 100 in general.

Figure 4:
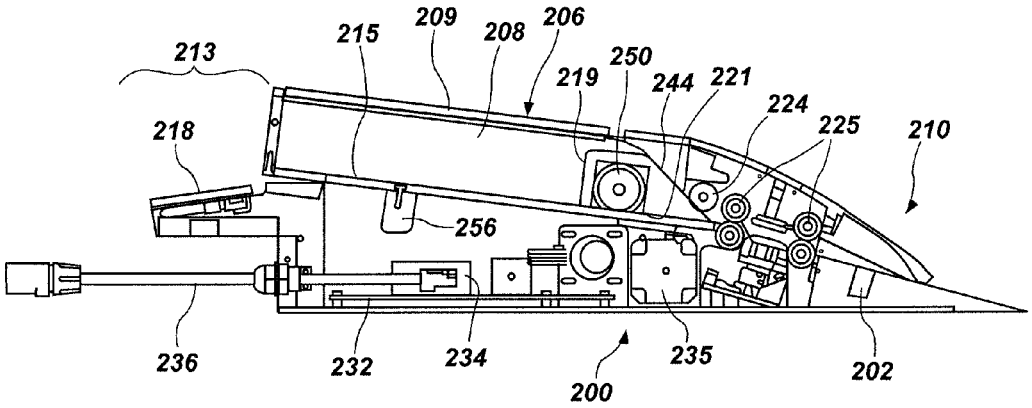
FIG. 4 is a cross-sectional side view of a dealing shoe according to an embodiment of the present disclosure.

FIG. 4 shows a cross-sectional side view of a dealing shoe 200 of the present disclosure, which may be used as the shoe 30 of the card-handling system 10 of FIG. 1. The dealing shoe 200 may be positioned at a playing table or other location where a card game is to be played. The dealing shoe 200 may be configured to receive a set of randomized cards from the automatic card shuffler 100 described above. The dealing shoe 200 may also be configured to receive a signal from the automatic card shuffler 100 indicating a selected set symbol that has been printed on each card of the set of randomized cards. For example, a wired data line 236 may be used to receive such a signal from the automatic card shuffler 100 or a wireless data connection may be used. The dealing shoe 200 may include a set symbol reader 202 configured to read a symbol on each card for comparison with the selected set symbol transmitted to the dealing shoe 200. Accordingly, the dealing shoe 200 may verify that each card dealt or to be dealt from the dealing shoe 200 belongs to the set of cards received from the automatic card shuffler 100. If any card does not include a set symbol that matches the selected set symbol, then the dealing shoe 200 may indicate the presence of the improper card and/or cease allowing cards to be removed from the dealing shoe 200, or the processor 234 associated with the dealing shoe 200 may generate an error signal. The error signal may, for example, be displayed on an input and display panel 218 or may be transmitted to another device, such as a control room server.

The dealing shoe 200 may be configured to receive a cartridge 206 of previously randomized cards from the automatic card shuffler 100 described above. In some embodiments, the cartridge 206 may be removable from the dealing shoe 200. For example, the card-supporting sides 134 of the automatic card shuffler 100 (FIGS. 2 and 3) may be in the form of the cartridge 206, and cards may be inserted into an internal chamber 208 of the cartridge 206 directly by the automatic card shuffler 100. In other embodiments, cards may be transferred by a person from the shuffled card return area 132 of the automatic shuffler 100 into the internal chamber 208 of the cartridge 206. In some embodiments, the cartridge 206 may be an integral portion of the dealing shoe 200 and may not be removable from the dealing shoe 200, and cards may be moved from the automatic card shuffler 100 and placed in the internal chamber 208 of the cartridge 206 for dealing from the dealing shoe 200. A removable lid 209 of the cartridge 206 may be removed to enable access to the internal chamber 208 for loading the dealing shoe 200 with cards or to otherwise provide access to the cards in the dealing shoe 200.

A movable weight 219 may be positioned within the cartridge 206 for pressing cards therein against an angled front surface 244 of the cartridge 206 and against at least one card-moving roller 224 of the dealing shoe 200, to enable the at least one card-moving roller 224 to contact a card and, by rotating responsive to operation of a motor 235, move the contacted card toward a card-dealing end 210 of the dealing shoe 200. A wheel 250 may be coupled to the movable weight 219 to reduce friction between a lower surface 215 of the cartridge 206 and a lower surface 221 of the weight 219 as the movable weight 219 moves along the lower surface 215. A stabilizing foot 256 on the cartridge 206 may align and stabilize the cartridge 206 relative to the dealing shoe 200 when positioned on the dealing shoe 200.

The input and display panel 218 may be positioned at an end 213 of the dealing shoe 200 opposite the card-dealing end 210. The input and display panel 218 may include inputs, such as inputs for identifying a card game to be played, commencing dealing of cards, stopping dealing of cards, resolving errors, etc. The input and display panel 218 may also be configured to display information to the dealer. For example, an indicator that a card does not include a set symbol that matches the selected set symbol may be displayed on the input and display panel 218. Such inputs and display elements (e.g., indicators) of the input and display panel 218 may be implemented in hardware, such as using buttons, lights, etc., or in software, such as using a touch screen that displays different inputs and display elements during operation. Additionally or alternatively, other indicators may include a visual display, an audible alarm, and a locking device configured to prevent cards from being removed after a card without the selected set symbol is detected by the dealing shoe 200.

The dealing shoe 200 may also include a circuit board 232, which includes a processor 234, for controlling and providing electrical power to various elements of the dealing shoe 200. For example, the processor 234 may control the presentation of cards at the card-dealing end 210 for removal, movement of cards by controlling the motor 235 and/or the card-moving rollers 224, 225, receipt of signals from an external source to identify a randomly selected set symbol, determination of whether cards include a set symbol matching the randomly selected set symbol by controlling the set symbol reader 202 and comparing read symbols with the expected randomly selected set symbol, indication of whether a card is detected that does not include a set symbol matching the randomly selected set symbol, receipt of commands from the input and display panel 218, display of information at the input and display panel 218, etc.

Figure 5:
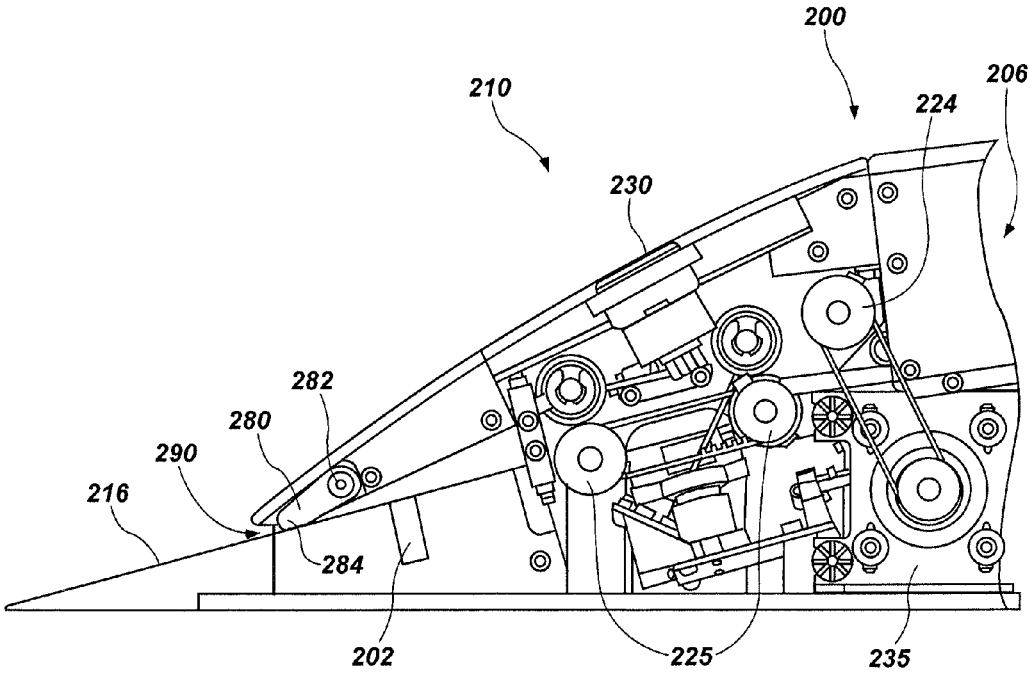
FIG. 5 is a cross-sectional side view of a card-dealing end of the dealing shoe of FIG. 4.

FIG. 5 illustrates the card-dealing end 210 of the dealing shoe 200 of FIG. 4 in greater detail. Referring to FIG. 5 in conjunction with FIG. 4, an activation button 230 may be used to initiate card dealing after a new cartridge 206 has been inserted into a cartridge receiving area of dealing shoe 200. The motor 235 may cause the one or more card-moving rollers 224 to rotate, resulting in movement of a card from the cartridge 206 toward one or more additional card-moving rollers 225 and toward a position from which the card may be removed from the dealing shoe 200, such as along a terminal surface 216 of the card-dealing end 210.

The card-dealing end 210 may include a set symbol reader 202, which may be configured to read each card and communicate with the processor 235 to determine whether each card includes a set symbol and that the set symbol matches the randomly selected set symbol identified by receiving a signal from the automatic card shuffler 100. As used herein, the phrase "matching the randomly selected set symbol" and related phrases mean that the expected set symbol is present on the card and no other unexpected set symbols are present on the card. Of course, if a card does not include any set symbol, then the card does not include a set symbol matching the randomly selected set symbol. In addition, if a card includes a set symbol different from the randomly selected set symbol, then the card does not include a set symbol matching the randomly selected set symbol. Furthermore, in some embodiments, if a card includes the randomly selected set symbol printed over or in addition to another unexpected symbol, then the card does not include a set symbol matching the randomly selected set symbol. Accordingly, even a card originally from another set of cards that previously received a first set symbol and that has the expected randomly selected set symbol printed over or in addition to the first set symbol may be identified as a card that does not properly belong to the set of cards.

The set symbol reader 202 may be any device that is capable of perceiving an invisible or visible symbol printed on each card in sufficient detail to determine if the card includes the expected set symbol. Accordingly, the set symbol reader 202 may include at least one magnifying lens, an imaging device (e.g., a camera), a light source (e.g., an ultraviolet light source, a laser source, a visible light source) for revealing or reading the symbol, and/or any other component or device configured to enable the set symbol reader 202 to perceive the particular set symbol printed on each card.

A toggle weight 280 that pivots about axis pin 282 may be positioned at the card-dealing end 210 of the dealing shoe 200. A front end 284 of the toggle weight 280 may be blunt or flattened to prevent any playing cards from being reinserted into opening 290 of the delivery shoe 200. The toggle weight 280 may also inhibit individual cards from inadvertently slipping out of the dealing shoe 200, and thus may define a stopping position for cards moved toward the opening 290. In some embodiments, the toggle weight 280 may be a component of a locking device of the dealing shoe 200, the locking device configured to hold the toggle weight 280 in a closed position (as shown in FIG. 5) when a card is identified that does not include a set symbol matching the expected randomly selected set symbol thereon. Thus, if the processor 234 determines that an improper card is present, one or more cards may be prevented from removal from the dealing shoe 200 by the locking device. In some embodiments, the toggle weight 280 may be automatically moved by a stepper motor controlled by the processor 234 from an open position (not shown) to a closed position (FIG. 5) and functions as a locking device. In other examples, the locking device may be implemented as a gate that is moved into a position to block the opening 290, or as the card-moving roller 224 and/or the one or more additional card-moving rollers 225 ceasing movement of cards toward the opening 290.

Accordingly, the present disclosure includes systems including an automatic card shuffler that randomly determines and prints a selected set symbol on every card of a set being shuffled. The systems also include a dealing shoe equipped with a set symbol reader for verifying that each card being dealt by the dealing shoe belongs to the set shuffled by the automatic card shuffler. Thus, embodiments of the present disclosure may enhance security, reduce errors caused by introduction of improper cards into the set of cards, and increase fairness of playing card games. The cost of these benefits may be somewhat lower than purchasing cards from card manufacturers that include enhanced security features, since any card that can be shuffled by the automatic card shuffler (including cards lacking any enhanced security feature) may be printed with a randomly selected set symbol. The random selection of the set symbol may further enhance security, since any person who attempts to cheat by introducing a card from another set of cards will be unlikely to predict or guess the randomly selected set symbol of a particular set of cards.

Figure 6:
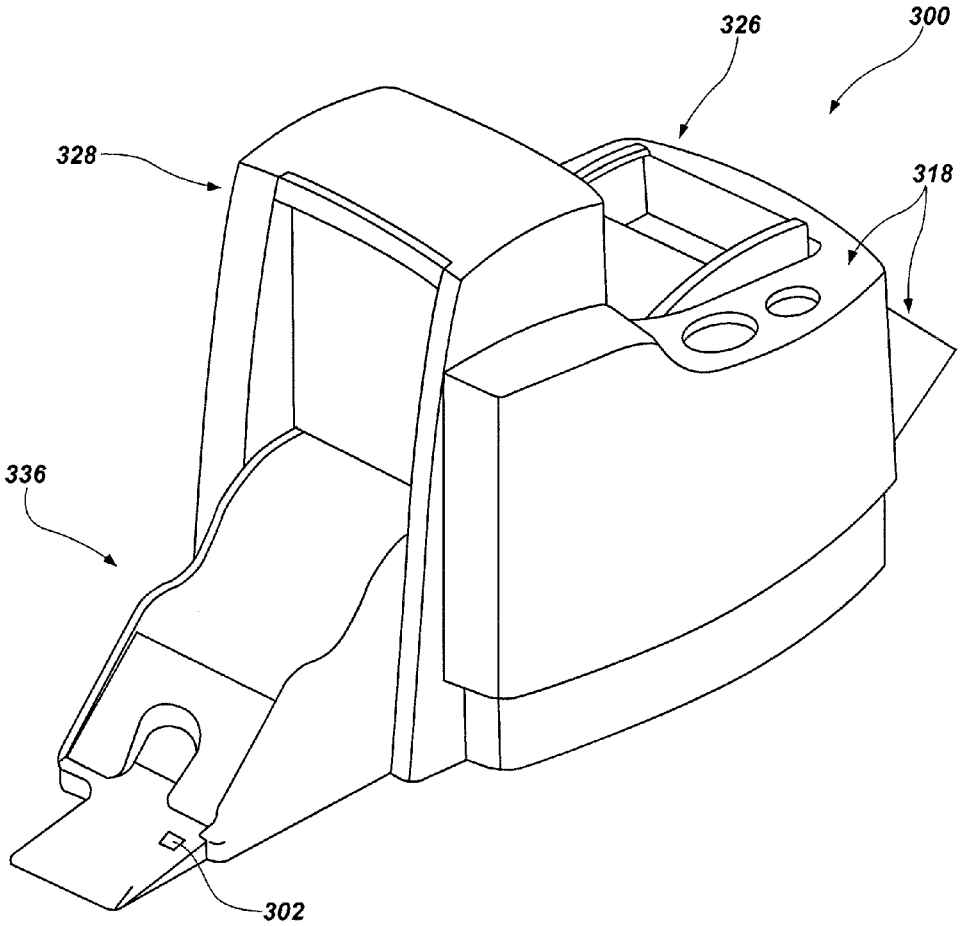
FIG. 6 is a perspective view of an automatic card shuffler according to an embodiment of the present disclosure.

FIG. 6 illustrates an automatic card shuffler 300 that includes a card infeed tray 326 for receiving a set of cards to be randomized, a card-shuffling mechanism 328, and a card output tray 336. The automatic card shuffler 300 may also include inputs and displays 318 similar in function to the input and display panel 218 described above with reference to FIGS. 4 and 5. The card output tray 336 may include a card-reading device 302 similar to the set symbol reader 202 described above with reference to FIGS. 4 and 5. Cards positioned within the card infeed tray 326 may be moved into the card-shuffling mechanism 328 and then into the card output tray 336 in a random order (compared to an order of the cards positioned within the card infeed tray 326). In addition, a randomly selected set symbol may be printed on each card by the automatic card shuffler 300, and the card-reading device 302 may verify that each card includes a set symbol matching the randomly selected set symbol, as described in more detail below.

Figure 7:
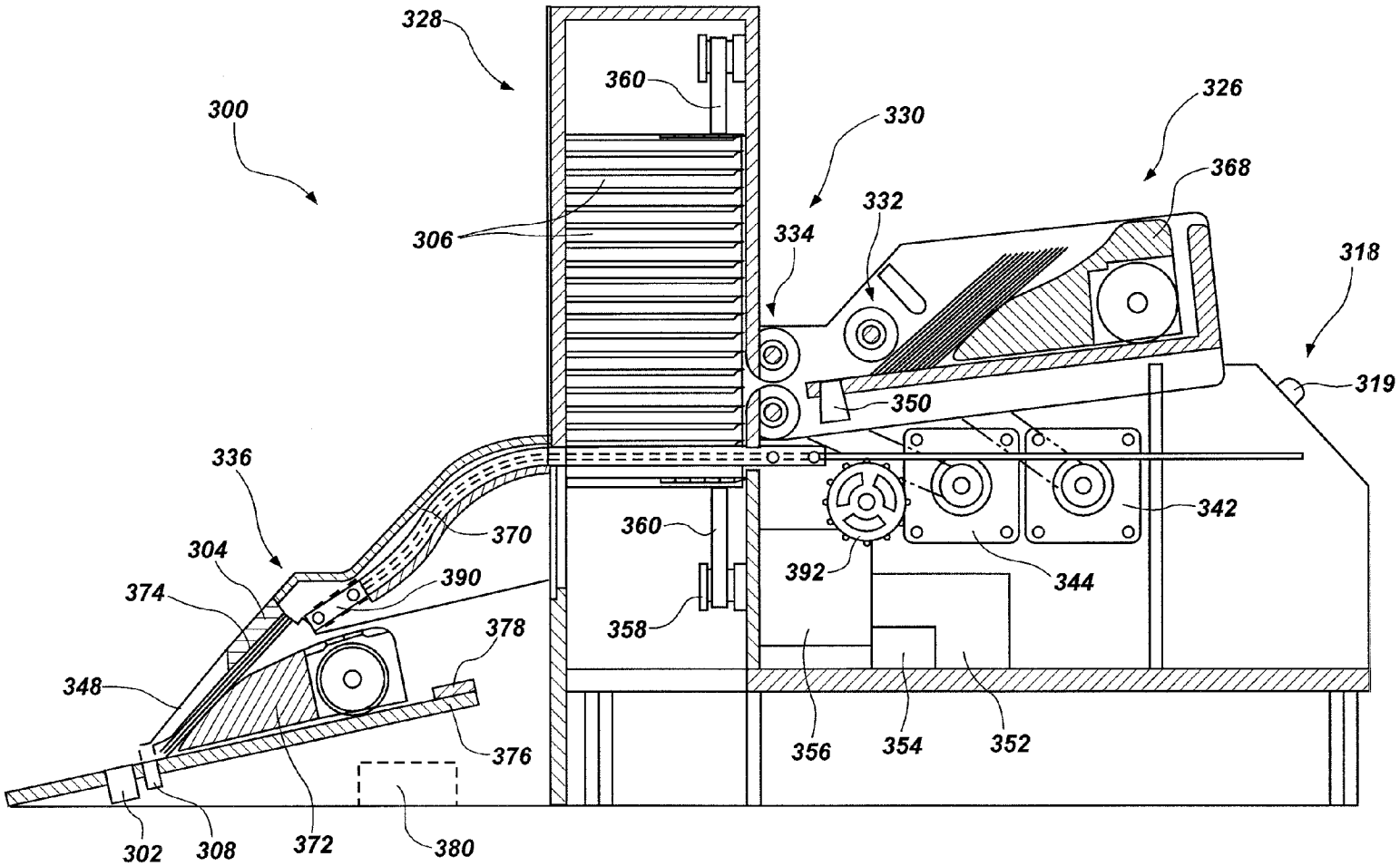
FIG. 7 is a simplified side view of internal components of the automatic card shuffler of FIG. 6.

Referring to FIG. 7, additional components of the automatic card shuffler 300 include a printing device 350 for printing a randomly selected set symbol on each card of a set of cards to be shuffled, a processor 352 configured (e.g., programmed) to control various other components of the automatic card shuffler 300, a card-moving mechanism 330 for moving cards from the card infeed tray 326 into the card-shuffling mechanism 328, a plurality of compartments 306 arranged in a vertical stack in the card-shuffling mechanism 328, and a pusher 390 for pushing cards from the card-shuffling mechanism 328 into the card output tray 336.

The printing device 350 may be similar in structure and function to the printing device 150 described above with reference to FIG. 3. The printing device 350 may be positioned to enable the printing device 350 to print a randomly selected set symbol on each card as each card is moved from the card infeed tray 326 into the card-shuffling mechanism 328 by the card-moving mechanism 330. The processor 352 may be configured (e.g., programmed) to randomly select a set symbol to be printed on each card of a set of cards by the printing device 350, such as by using a random number generator (RNG) 354 (implemented in hardware or software). The set symbol to be printed on each card of a set of cards by the printing device 350 may be randomly selected when a shuffling cycle is commenced, such as responsive to a dealer positioning a set of cards in the card infeed tray 326 and/or interacting with the inputs and displays 318. The processor 352 may also be configured (e.g., programmed) to control the card-shuffling mechanism 328, such as by selecting a random compartment 306 to receive each card, up to a maximum number of cards that can fit into each compartment 306.

The card-shuffling mechanism 328 may include an elevator motor 356 controlled by the processor 352 for moving the compartments 306 into position to receive one or more cards from the card infeed tray 326 and into position to remove cards from the compartments 306 into the card output tray 336. For example, the elevator motor 356 may be configured to rotate an elevator roller 358 coupled to an elevator belt 360. The compartments 306 may be coupled to the elevator belt 360 such that movement of the elevator belt 360 by rotation of the elevator roller 358 causes the compartments 306 to move vertically.

The card-moving mechanism 330 may include a first roller 332 and second rollers 334. The first roller 332 may be positioned to contact a card of the set of cards in the card infeed tray 326 urged toward the first roller 332 by an infeed block 368 similar to the movable weight 219 described above with reference to FIG. 4. A first roller motor 342 controlled by the processor 352 may be operatively coupled to the first roller 332 to cause the first roller 332 to rotate to move a leading card from the set of cards over the printing device 350 and toward the card-shuffling mechanism 328. Similarly, the second rollers 334 may be operatively coupled to a second roller motor 344 controlled by the processor 352. Optionally, the second rollers 334 may be configured to stop each card over the printing device 350 for a sufficient time to print a randomly selected symbol on each card at a predetermined location on the card. Before each card is moved by the second rollers 334 into a respective compartment 306, the processor 352 may cause the elevator motor 356 to move a randomly selected compartment 306 into a position to receive the card.

Each of the compartments 306 may be sized to receive one or more cards therein. In some embodiments, each compartment 306 may be capable of receiving a full or a partial hand of cards for a game to be played. For example, if the game to be played using the set of cards randomized by the automatic card shuffler 300 is five-card poker, each compartment 306 may be sized to provide space for five cards. In other embodiments, each compartment 306 may be sized to provide space for one, two, three, four, five, six, or seven cards. One of the compartments 306 may be a discard compartment sized to receive more cards than a single hand of cards for the game to be played.

A pusher 390 may be configured to push one or more cards out of each compartment 306 and into the card output tray 336. By way of example and not limitation, the pusher 390 may include an elongated flexible member configured to be extended and retracted by a pusher motor using a toothed gear 392. After all cards of the set of cards initially positioned within the card infeed tray 326 are randomly positioned within respective compartments 306, cards within the compartments 306 may be moved into the card output tray 336 by the pusher 390. The elevator motor 356 may respectively position each compartment 306 in a location aligned with a card way 370 to enable the pusher 390 to push the one or more cards out of each compartment 306 as a group. Upon being pushed out of the compartment(s) 306, the card(s) may travel through the card way 370 and may then be positioned between an output block 372 and the terminal end plate 304 for removal from the card output tray 336. The output block 372 may be similar to the infeed block 368 and may be used to push the card(s) against the terminal end plate 304. An inverted U-shaped opening 348 in the terminal end plate 304 may enable a top front card within the card output tray 336 to be contacted by a finger of a dealer such that the dealer may remove the top card from the card output tray 336.

As additional cards are pushed by the pusher 390 toward the terminal end plate 304, the additional cards may be positioned between the output block 372 and any cards 374 already delivered and/or the terminal end plate 304, urging the output block 372 to slide up an angled floor 376 to provide space for the additional cards. The output block 372 may be able to slide up the angled floor 376 until the output block 372 reaches a stop 378 positioned to limit movement of the output block 372. However, in other embodiments, the stop 378 may be omitted and the output block 372 may be free to slide up the angled floor 376 until the output block 372 comes to rest against another feature of the automatic card shuffler 300, such as a wall of the card-shuffling mechanism 328. Accordingly, the card output tray 336 may be configured to hold any number of cards ready for removal, such as from one card up to a number of cards of the entire set of cards to be randomized by the automatic card shuffler 300 (e.g., 52 cards if a 52-card deck is used as the set of cards). In some embodiments, cards delivered to the card output tray 336 at any given time may form a partial or a full hand of cards for a selected game. In other embodiments, a small number of cards, such as 12 or fewer cards, may be present in the card output tray 336 at any given time.

The card-reading device 302 may be configured to read at least a set symbol on each card delivered to the card output tray 336, such as when each card is removed from the card output tray 336. The card-reading device 302 may be in information communication with the processor 352. Thus, the processor 352 may be configured (e.g., programmed) to compare an image of a card surface or other information (e.g., a sequence of numbers, letters, or other symbols) received from the card-reading device 302 with the expected randomly selected set symbol.

The card-reading device 302 may be positioned and configured to read each card upon removal from the card output tray 336. Information read may be communicated to the processor 352, which may determine whether the card being read includes a set symbol matching the randomly selected set symbol, to determine whether the card belongs to the set of cards initially positioned within the card infeed tray 326. Thus, tampering or errors may be detected, such as one or more cards being purposely or inadvertently left in the compartments 306 during a game previously played using the automatic card shuffler 300. In addition, an unauthorized card inserted into the set of cards in the card infeed tray 326 from a different set of cards and having a different set symbol (e.g., a card retained by a player from a previous game using the automatic card shuffler 300) may be detected due to the randomly selected set symbol being superimposed over a previous set symbol or a previous set symbol being additionally printed on the card.

In some embodiments, the card output tray 336 may be detachable from the card infeed tray 326 and the card-shuffling mechanism 328 of the automatic card shuffler 300. Accordingly, the card output tray 336 may be implemented as a dealing shoe that is dockable and removably attached to the card-shuffling mechanism 328. In such embodiments, each card of a set of cards positioned in the card infeed tray 326 may receive a randomly selected set symbol from the printing device 350, and the set of cards may be randomized by the card-shuffling mechanism 328, as described above. Then, all cards may be moved from the card-shuffling mechanism 328 to the card output tray 336. The output block 372, angled floor 376, and stop 378 (if present), may be configured and sized to hold an entire set of cards. After all cards are moved from the shuffling mechanism 328 to the card output tray 336, the card output tray 336 may be detached from the card-shuffling mechanism 328 and moved to a location for dealing the cards in a card game, such as to a gaming table. By way of example, a suitable quick coupling mechanism is described in U.S. Pat. RE42,944, titled "Card Shuffling Device," reissued on Nov. 22, 2011, the entire disclosure of which is incorporated by reference herein. The card-reading device 302 may be configured to detect any card from another set of cards (i.e., other than the set of cards positioned in the card output tray 336 by the automatic card shuffler 300) introduced into the card output tray 336 without authorization, such as a card introduced through the card way 370 during transport of the card output tray 336 to a gaming table.

In embodiments in which the card output tray 336 is detachable, the card output tray 336 may include another processor 380 (shown in FIG. 7 in phantom lines) in communication with the card-reading device 302, the another processor 380 being configured (e.g., programmed) to receive images or other information from the card-reading device 302 and to determine whether each card includes a set symbol matching the randomly selected set symbol. The another processor 380 may, at least when the card output tray 336 is attached to the card-shuffling mechanism 328 and the card infeed tray 326, be in information communication with the processor 352 of the automatic card shuffler 300. Thus, the another processor 380 of the card output tray 336 may receive an indication from the processor 352 of the automatic card shuffler 300 identifying the randomly selected set symbol of the set of cards moved from the card-shuffling mechanism 328 into the card output tray 336 for comparison with images or other information received from the card-reading device 302. A data connection for providing the information communication between the processor 352 of the automatic card shuffler 300 and the another processor 380 of the card output tray 336 may be provided by one or more of a wireless connection, a hard wired connection, a data bus, a table system network, a local area network, a wide area network, a wireless network, and a cell phone network.

If it is determined by the card-reading device 302 and processor 352 (or the processor 380) that a card does not include a set symbol matching the randomly selected set symbol, the automatic card shuffler 300 may provide an indication of the error. The indication of the error may be associated with the card output tray 336 (e.g., in an embodiment employing a detachable card output tray 336) and/or with the inputs and displays 318. For example, in some embodiments, an indicator light 319 may provide a visual indication that a card read by the card-reading device 302 does not belong to the expected set of cards. The inputs and displays 318 may include a display screen that provides a visual display indicating the error. An audible alarm may alternatively or additionally sound to indicate the error. By way of another example, the automatic card shuffler 300 may include a locking device, such as in the form of a card stop 308, configured to prevent additional cards from being removed from the card output tray 336 after a card is drawn bearing a set symbol that does not match the selected set symbol or lacking the selected set symbol. In such an embodiment, the card stop 308 may be configured to move between an open position (shown in FIG. 7 in solid lines) allowing cards to be removed from the card output tray 336 and a closed position (shown in FIG. 7 in phantom lines) preventing cards from being removed from the card output tray 336. An example of a suitable card stop is a solenoid-actuated cylinder that blocks the card path in a first position and is free of the card path in a second position. A locking device may also be implemented by the pusher 390 and pusher motor being configured to cease moving cards from the card-shuffling mechanism 328 to the card output tray 336 when a card is detected that does not include a set symbol matching the selected set symbol.

As explained above, the automatic card shuffler 300 may provide improved security, confidence, and fairness in games using playing cards. Such benefits may be accomplished without the necessity of purchasing expensive cards with enhanced security features. The automatic card shuffler 300 may also discourage individuals from cheating or making errors in the transportation and handling of cards.

Additional, non-limiting example embodiments of the present disclosure are set forth below.

Embodiment 1

A system for handling and verifying sets of cards, the system comprising: an automatic card shuffler, comprising: a card-shuffling mechanism configured to shuffle a set of cards; a shuffler processor programmed to randomly select a set symbol; and a printing device for applying the randomly selected set symbol to each card in the set of cards prior to removal of the set of cards from the shuffler; and a shoe comprising: a receptacle for receiving the set of cards from the automatic card shuffler; a set symbol reader for reading each card of the set of cards for a presence and identity of a set symbol; and a shoe processor configured to receive a signal from the shuffler processor indicating the selected set symbol and configured to verify that each card of the set of cards includes a set symbol matching the selected set symbol.

Embodiment 2

The system of Embodiment 1, further comprising a data connection between the shuffler processor and the shoe processor for transmitting the signal indicating the selected set symbol.

Embodiment 3

The system of Embodiment 2, wherein the data connection is selected from the group consisting of: a wireless connection, a hard wired connection, a data bus, a table system network, a local area network, a wide area network, a wireless network, and a cell phone network.

Embodiment 4

The system of any one of Embodiments 1 through 3, wherein the shoe further comprises an indicator configured to indicate when a card of the set of cards does not include the selected set symbol.

Embodiment 5

The system of Embodiment 4, wherein the indicator is selected from the group consisting of a visual display, an audible alarm, and a locking device of the shoe configured to prevent cards from being removed from the shoe after a card without the selected set symbol is detected by the shoe.

Embodiment 6

The system of any one of Embodiments 1 through 5, wherein the shoe further comprises a locking device configured to prevent a card marked with a set symbol that does not match the selected set symbol or a card lacking the selected set symbol from being removed from the shoe.

Embodiment 7

The system of any one of Embodiments 1 through 6, wherein the shoe further comprises a locking device configured to prevent additional cards from being removed from the shoe after a card is drawn bearing a set symbol that does not match the selected set symbol or lacking the selected set symbol.

Embodiment 8

The system of any one of Embodiments 1 through 7, wherein the printing device is selected from the group consisting of a bar code printer, a dot matrix printer, an ink jet printer, a laser printer, an embosser, a debosser, a scratching device, a laser ablation device, a stamp, and a nano-marking device.

Embodiment 9

The system of any one of Embodiments 1 through 7, wherein the printing device is selected from the group consisting of an embosser, a debosser, a scratching device, and a laser ablation device.

Embodiment 10

A method of verifying that cards to be removed from a card-handling device belong to a particular set of cards, comprising: forming a randomly determined set symbol on each card in the set of cards with a first card-handling device; transmitting with a data transmission device of the first card-handling device a signal representing the randomly determined set symbol to a second card-handling device; and detecting with the second card-handling device whether each card of the set of cards includes a set symbol matching the randomly determined set symbol.

Embodiment 11

The method of Embodiment 10, further comprising, when a card does not include a set symbol matching the randomly determined set symbol, providing a signal indicating a card does not belong to the set.

Embodiment 12

The method of Embodiment 10 or 11, further comprising selecting the first card-handling device from the group consisting of a shuffler and a deck verification device.

Embodiment 13

The method of any one of Embodiments 10 through 12, further comprising randomly determining the set symbol to be formed on each card with a random number generator of the first card-handling device.

Embodiment 14

The method of any one of Embodiments 10 through 13, further comprising receiving with a data reception device of the second card-handling device a signal indicating the randomly determined set symbol.

Embodiment 15

The method of any one of Embodiments 10 through 14, wherein detecting with the second card-handling device whether each card therein includes a set symbol matching the randomly determined set symbol comprises comparing a detected symbol of each card with the randomly determined set symbol.

Embodiment 16

The method of any one of Embodiments 10 through 15, wherein providing a signal indicating a card does not belong to the particular set of cards comprises one or more of providing an audible alarm, providing a visual alert, and causing the second card-handling device to preclude removal of cards therefrom.

Embodiment 17

An automatic card shuffler, comprising: a card infeed tray; a card-shuffling mechanism; a card output tray; a processor programmed to randomly select a set symbol to form on each card in a set of cards; and a card-marking system for forming the randomly selected set symbol on each card received in the card infeed tray prior to delivery of each card to the card output tray.

Embodiment 18

The automatic card shuffler of Embodiment 17, further comprising a card-reading device for reading set symbols on cards delivered to the card output tray, wherein the card-reading device is in information communication with the processor.

Embodiment 19

The automatic card shuffler of Embodiment 18, wherein the processor is configured to generate a signal indicating a delivered card does not include a set symbol matching the randomly selected set symbol.

Embodiment 20

The automatic card shuffler of any one of Embodiments 17 through 19, wherein the card-marking system is positioned in the automatic card shuffler to form the randomly selected set symbol on each card prior to each card reaching the card-shuffling mechanism.

Embodiment 21

The automatic card shuffler of any one of Embodiments 17 through 20, wherein the card-marking system is positioned in the automatic card shuffler to form the randomly selected set symbol on each card while each card is positioned in the card infeed tray.

Embodiment 22

The automatic card shuffler of any one of Embodiments 17 through 21, wherein the card-marking system is configured to form the randomly selected set symbol on each card by one of applying a visible ink to the card, applying an invisible ink to the card, removing material of the card, burning the card, embossing the card, and debossing the card.

Embodiment 23

The automatic card shuffler of any one of Embodiments 17 through 22, wherein the processor programmed to randomly select a set symbol to form on each card in a set of cards comprises the processor programmed to randomly select a set symbol selected from the group consisting of a random sequence of numbers, a random sequence of letters, a random sequence of special characters, a random bar code, a random dot matrix code, a random pictograph, a random sequence of foreign language symbols, and combinations thereof.

Embodiment 24

The automatic card shuffler of any one of Embodiments 17 through 23, wherein the card output tray is detachable from the card-shuffling mechanism and the card infeed tray.

Systems of the present disclosure may provide greater security as compared to card-handling devices that read a casino code, or manufacturer-applied markings. Cards with the same markings can be added to a show by casino personnel or players and those added cards may not be detected. By randomly selecting a card marking, applying the marking, transmitting a marking code to a second card-handling device, and then reading the randomly selected markings, an improved level of game security can be achieved. Even if the marked cards are stored before loading into a card shoe, casino table game security is increased because the card markings may be invisible to the human eye (either because the cards are marked with markings not perceptible in the visible light spectrum or because special equipment such as a magnifier or other decoder may be required to read the selected symbol). Thus, the present disclosure may provide additional barriers to a player or dealer desiring to insert one or more cards that are not part of the casino's set of cards, and/or such cards may be detected by the systems of the present disclosure.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including their legal equivalents. In addition, features from one disclosed embodiment may be combined with features of another disclosed embodiment while still lying within the scope of the disclosure.

What is claimed is:

1. A system for handling and verifying sets of playing cards, the system comprising:

an automatic card shuffler, comprising:

a card-shuffling mechanism configured to shuffle a set of playing cards;

a shuffler processor programmed to randomly select a set symbol; and a printing device for applying the same randomly selected set symbol to each card in the set of playing cards to uniquely identify the set of playing cards prior to removal of the set of playing cards from the automatic card shuffler; and a shoe comprising:

a receptacle for receiving the set of playing cards from the automatic card shuffler;

a set symbol reader for reading each card of the set of playing cards for a presence and identity of a set symbol; and a shoe processor configured to receive a signal from the shuffler processor indicating the randomly selected set symbol and configured to verify that each card of the set of playing cards includes a set symbol matching the randomly selected set symbol.

2. The system of claim 1, further comprising a data connection between the shuffler processor and the shoe processor for transmitting the signal indicating the selected set symbol.

3. The system of claim 2, wherein the data connection is selected from the group consisting of: a wireless connection, a hard wired connection, a data bus, a table system network, a local area network, a wide area network, a wireless network, and a cell phone network.

4. The system of claim 1, wherein the shoe further comprises an indicator configured to indicate when a card of the set of playing cards does not include the selected set symbol.

5. The system of claim 4, wherein the indicator is selected from the group consisting of a visual display, an audible alarm, and a locking device of the shoe configured to prevent cards from being removed from the shoe after a card without the selected set symbol is detected by the shoe.

6. The system of claim 1, wherein the shoe further comprises a locking device configured to prevent a card marked with a set symbol that does not match the selected set symbol or a card lacking the selected set symbol from being removed from the shoe.

7. The system of claim 1, wherein the shoe further comprises a locking device configured to prevent additional cards from being removed from the shoe after a card is drawn bearing a set symbol that does not match the selected set symbol or lacking the selected set symbol.

8. The system of claim 1, wherein the printing device is selected from the group consisting of a bar code printer, a dot matrix printer, an ink jet printer, a laser printer, a stamp, a nano-marking device, an embosser, a debosser, a scratching device, and a laser ablation device.

9. A method of verifying that playing cards to be removed from a card-handling device belong to a particular set of playing cards, the method comprising:

inserting the particular set of playing cards into a first card-handling device comprising a printing device, a card-moving mechanism, and a random number generator;

randomly determining a set symbol to be formed on each card in the particular set of playing cards with the random number generator of the first card-handling device;

forming the same randomly determined set symbol on each card in the particular set of playing cards with the printing device of the first card-handling device to uniquely identify the set of playing cards;

moving the particular set of playing cards from the first card-handling device to a second card-handling device;

transmitting with a data transmission device of the first card-handling device a signal representing the randomly determined set symbol to the second card-handling device; and detecting with the second card-handling device whether each card therein includes a set symbol matching the randomly determined set symbol transmitted from the first card-handling device to the second card-handling device.

10. The method of claim 9, further comprising, when a card does not include a set symbol matching the randomly determined set symbol, providing a signal indicating that a card does not belong to the particular set of playing cards.

11. The method of claim 9, further comprising receiving with a data reception device of the second card-handling device a signal indicating the randomly determined set symbol.

12. The method of claim 9, wherein providing a signal indicating a card does not belong to the particular set of playing cards comprises one or more of providing an audible alarm, providing a visual alert, and causing the second card-handling device to preclude removal of cards therefrom.

13. The method of claim 9, wherein the first card-handling device is selected from the group consisting of an automatic card shuffler, a card counter, a card storage device, a card verification device, a card-printing device, or a card reader.

14. The method of claim 9, wherein the second card-handling device is selected from the group consisting of an automatic card shuffler, a card counter, a card-dealing shoe, a card storage device, a card verification device, or a card reader.

15. An automatic card shuffler, comprising:

a card infeed tray configured to receive a set of playing cards to be shuffled;

a card-shuffling mechanism configured to receive and randomize the order of cards from the set of playing cards in the card infeed tray;

a card output tray configured to receive shuffled playing cards from the card-shuffling mechanism;

a processor programmed to randomly select a set symbol to form on each card in the set of playing cards; and a card-marking system for forming, prior to delivery of each card to the card output tray, the same randomly selected set symbol on each card received in the card infeed tray.

16. The automatic card shuffler of claim 15, further comprising a card-reading device for reading set symbols on cards delivered to the card output tray, wherein the card-reading device is in information communication with the processor.

17. The automatic card shuffler of claim 16, wherein the processor is configured to generate a signal indicating a delivered card does not include a set symbol matching the randomly selected set symbol.

18. The automatic card shuffler of claim 15, wherein the card-marking system is positioned in the automatic card shuffler to form the randomly selected set symbol on each card prior to each card reaching the card-shuffling mechanism.

19. The automatic card shuffler of claim 15, wherein the card-marking system is configured to form the randomly selected set symbol on each card by one of applying a visible ink to the card, applying an invisible ink to the card, removing material of the card, burning the card, embossing the card, and debossing the card.

20. The automatic card shuffler of claim 15, wherein the processor programmed to randomly select a set symbol to form on each card in a set of playing cards comprises the processor programmed to randomly select a set symbol selected from the group consisting of a random sequence of numbers, a random sequence of letters, a random sequence of special characters, a random bar code, a random dot matrix code, a random pictograph, a random sequence of foreign language symbols, and combinations thereof.

21. The automatic card shuffler of claim 15, wherein the card output tray is detachable from the card-shuffling mechanism and the card infeed tray.

* * * * *